US010292448B2

(12) United States Patent
Warmouth et al.

(10) Patent No.: US 10,292,448 B2
(45) **Date of Patent: *May 21, 2019**

(54) CATCHER'S HELMET WITH FACE GUARD HAVING RAISED EYEBROW AREAS

(71) Applicant: KRANOS IP CORPORATION, Litchfield, IL (US)

(72) Inventors: Cortney Warmouth, Edwardsville, IL (US); Louis Anthony VanHoutin, Iuka, IL (US); Vincent R. Long, St. Peters, MO (US); Dan Meyer, Litchfield, IL (US)

(73) Assignee: KRANOS IP CORPORATION, Litchfield, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/019,187

(22) Filed: Jun. 26, 2018

(65) Prior Publication Data

US 2018/0303188 A1 Oct. 25, 2018

Related U.S. Application Data

(63) Continuation of application No. 15/649,258, filed on Jul. 13, 2017, now Pat. No. 10,085,509, which is a (Continued)

(51) Int. Cl.
*A42B 3/20* (2006.01)
*A42B 3/12* (2006.01)
(Continued)

(52) U.S. Cl.
CPC ..... *A42B 3/127* (2013.01); *A42B 3/20* (2013.01); *A42B 3/283* (2013.01); *A42B 3/32* (2013.01)

(58) Field of Classification Search
CPC ..... A42B 3/127; A42B 3/00; A42B 3/222; A42B 3/324; A42B 3/08; A42B 3/06; A42B 3/20; A63B 71/10
See application file for complete search history.

(56) References Cited

U.S. PATENT DOCUMENTS 287,331 A 10/1883 Schaap
2,715,222 A 8/1955 Sowle
(Continued)

FOREIGN PATENT DOCUMENTS

GB 2535639 A 8/2016

*Primary Examiner* — Tajash D Patel
(74) *Attorney, Agent, or Firm* — Notaro, Michalos & Zaccaria P.C.

(57) ABSTRACT

A catcher's mask comprises a two-piece plastic shell composed of a rigid front shell and a rigid rear shell. The front and rear shells are connected by a strap harness attached to the front shell and have padding assemblies. The front shell has ventilation holes including ear holes positioned over the wearer's ears and a full jaw protector integrally formed as part of front shell. A wire faceguard is removably attached to the front shell extending over the ear holes. A top upper member of the faceguard comprises a center bar part, a left side bar part bent upwardly with respect to the center bar part to form a left eyebrow area, and a right side bar part bent upwardly with respect to the center bar part to form a right eyebrow area. The rear shell has a concave padding assembly comprised of a concave TPU shock absorbing layer, and a nested concave comfort layer.

10 Claims, 21 Drawing Sheets

Related U.S. Application Data continuation of application No. 14/878,431, filed on Oct. 8, 2015, now Pat. No. 9,743,702.

(60) Provisional application No. 62/159,075, filed on May 8, 2015.

(51) Int. Cl.
*A42B 3/28* (2006.01)
*A42B 3/32* (2006.01)

(56) References Cited

U.S. PATENT DOCUMENTS 3,139,624 A 7/1964 Humphrey
3,373,443 A 3/1968 Marietta
4,031,564 A 6/1977 Wood
D289,568 S 4/1987 Nimmons
D289,569 S 4/1987 Nimmons
D298,868 S 12/1988 Kiindt
4,837,866 A 6/1989 Rector
5,263,203 A 11/1993 Kraemer
5,390,367 A 2/1995 Rush, III
D358,686 S 5/1995 Kraemer
D381,127 S 7/1997 Rothwell
5,661,849 A 9/1997 Hicks
5,787,513 A 8/1998 Sharmat
5,893,174 A * 4/1999 Primeau ..... A42B 3/20 2/10
5,953,761 A * 9/1999 Jurga ..... A42B 3/145 2/414
6,102,424 A 8/2000 Cole, Jr.
6,189,156 B1 * 2/2001 Loiars ..... A42B 3/20 2/424
D448,528 S 9/2001 Fujimoto et al.
6,301,719 B1 10/2001 Goodhand
D463,885 S 10/2002 Burns
D465,067 S 10/2002 Ide et al.
D466,651 S 12/2002 Halstead et al.
D480,839 S 10/2003 Hicks, Jr.
D508,298 S 8/2005 Bernacchi et al.
D509,928 S 9/2005 Barnoski
D512,534 S 12/2005 Maddux et al.
D575,458 S 8/2008 Ho
D584,001 S 12/2008 Hunter et al.
D587,852 S 3/2009 Nimmons
D587,853 S 3/2009 Nimmons
D587,854 S 3/2009 Nimmons et al.
D587,855 S 3/2009 Nimmons et al.
D587,857 S 3/2009 Nimmons et al.
D590,106 S 4/2009 Nimmons
D598,610 S 8/2009 Soukup et al.
D603,099 S 10/2009 Bologna et al.
D625,050 S 10/2010 Ctien
D629,162 S 12/2010 Daniei
8,069,498 B2 12/2011 Maddux et al.
D654,630 S 2/2012 Chou et al.
8,176,574 B2 5/2012 Bryant
8,209,784 B2 7/2012 Nimmons
8,572,767 B2 11/2013 Bryant
2004/0025231 A1 2/2004 Ide
2005/0278835 A1 12/2005 Ide et al.
2006/0143765 A1 7/2006 Halstead et al.
2007/0266471 A1 * 11/2007 Lin ..... A42B 3/20 2/9
2008/0022441 A1 1/2008 Oranchak et al.
2009/0044316 A1 2/2009 Udelhofen
2009/0083891 A1 * 4/2009 Cote ..... A42B 3/20 2/9
2009/0083900 A1 4/2009 Wallace
2009/0106883 A1 4/2009 Wade
2009/0265841 A1 10/2009 Ferrara
2011/0131695 A1 6/2011 Maddux et al.
2011/0131710 A1 6/2011 Maddux et al.
2011/0214224 A1 9/2011 Maddux et al.
2011/0214225 A1 9/2011 Norris
2012/0124721 A1 5/2012 Hampton, II
2013/0312165 A1 11/2013 Hardy
2014/0150168 A1 6/2014 Erb
2014/0187875 A1 7/2014 Paris
2014/0223646 A1 8/2014 Bologna
2015/0033457 A1 2/2015 Tryner
2015/0230537 A1 8/2015 Warmouth
2015/0335092 A1 11/2015 Erb
2016/0324247 A1 * 11/2016 Warmouth ..... A42B 3/127

* cited by examiner

CATCHER'S HELMET WITH FACE GUARD HAVING RAISED EYEBROW AREAS

CROSS-REFERENCE TO RELATED APPLICATIONS

This application is a continuation of U.S. patent application Ser. No. 15/649,258 filed Jul. 13, 2017, now U.S. Pat. No. 10,085,509, which is a continuation of U.S. patent application Ser. No. 14/878,431 filed Oct. 8, 2015, now U.S. Pat. No. 9,743,702, which claims priority from U.S. Provisional Application Ser. No. 62/159,075 filed May 8, 2015 which is incorporated herein by reference. U.S. patent application Ser. Nos. 15/649,258 and 14/878,431 and U.S. Provisional Application Ser. No. 62/159,075 are incorporated herein by reference for all purposes.

FIELD AND BACKGROUND OF THE INVENTION

The subject technology relates generally to the field of protective helmets and masks, and in particular to helmets and protective masks for baseball, softball, hockey and similar sports.

SUMMARY

According to the subject technology, protective sports headgear, such as a catcher's mask, comprises a two-piece shell formed of a suitable material such as polycarbonate or acrylonitrile butadiene styrene plastic and adapted to receive and protect the head of a wearer. The two-piece shell is composed of a rigid front shell, which protects the front, sides, and crown of the head, and a rigid rear shell, which protects the back of the head. The front shell and rear shell are connected by a harness of straps attached to the front shell by snap buckles.

The front shell may have through-going ventilation holes including ear holes positioned over the wearer's ears. The front shell may include a full jaw protector integrally formed as part of front shell. The jaw protector may have ventilation holes.

A faceguard for protecting the face of the wearer and comprised of wire members may be removably attached to the front shell with straps and/or nuts. The faceguard may extend over the ear holes to better protect the ear region from blows during sports play. The faceguard may include raised eyebrow areas on the left and right side of the uppermost member of the faceguard. The eyebrow areas may be positioned above a top edge of the face opening of the front shell.

The mask includes padding assemblies on the inner surfaces of the front and rear shells for shock absorption, protection, comfort, and to size the mask to the wearer. In the front shell, the padding assemblies include a front liner installed in the brow area, crown area, and side areas of the shell, and a middle liner extending around the rear inner surface of the front shell from the left lower edge to the right lower edge of the front shell. The front liner and middle liner are each comprised of a thermoformed thermoplastic urethane ("TPU") shock absorbing layer bonded to a inner comfort layer. The inner comfort layer comprises an inner polyvinyl or TPU sheet bonded to the shock absorbing layer, forming pockets therebetween which can be filled wholly or partially with foam material such as a memory foam. A comfortable foam padding assembly is also removably mounted to the inner surface of the jaw protector. A central chin pad comprising a foam member may be removably attached to the center of the inner surface of the jaw protector.

In the rear shell, a concave padding assembly is provided. The concave padding assembly is comprised of a concave thermoformed TPU shock absorbing layer, shaped to nest within the rear shell. A concave comfort layer, which may be comprised of foam material is removably attached to the inner surface of the concave shock absorbing layer and is shaped to nest within the concave shock absorbing layer.

Further advantages, as well as details of the present invention ensue from the following description of the attached drawings.

DETAILED DESCRIPTION OF THE DRAWINGS

Figure 1:
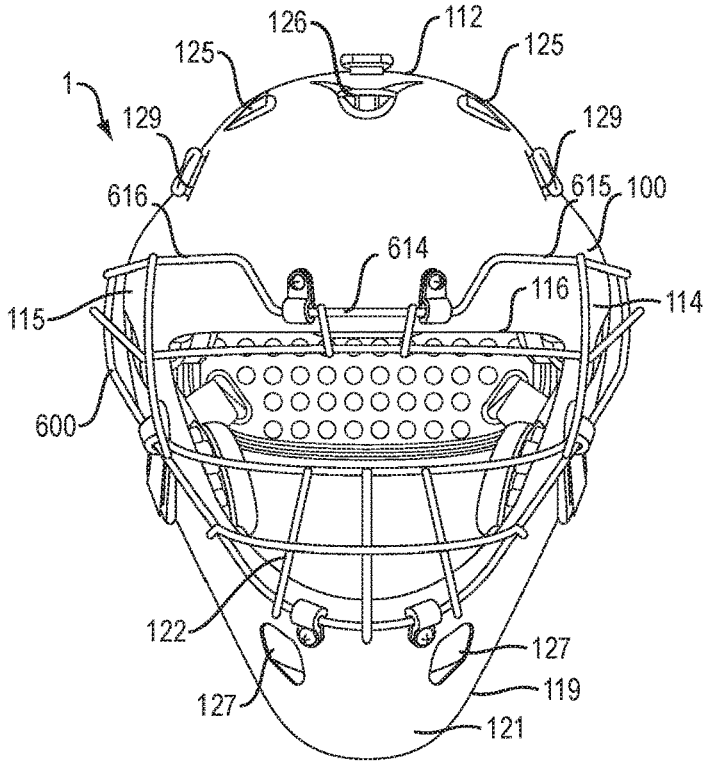
FIG. 1 is a front view of a catcher's mask according to the subject technology.
Figure 2:
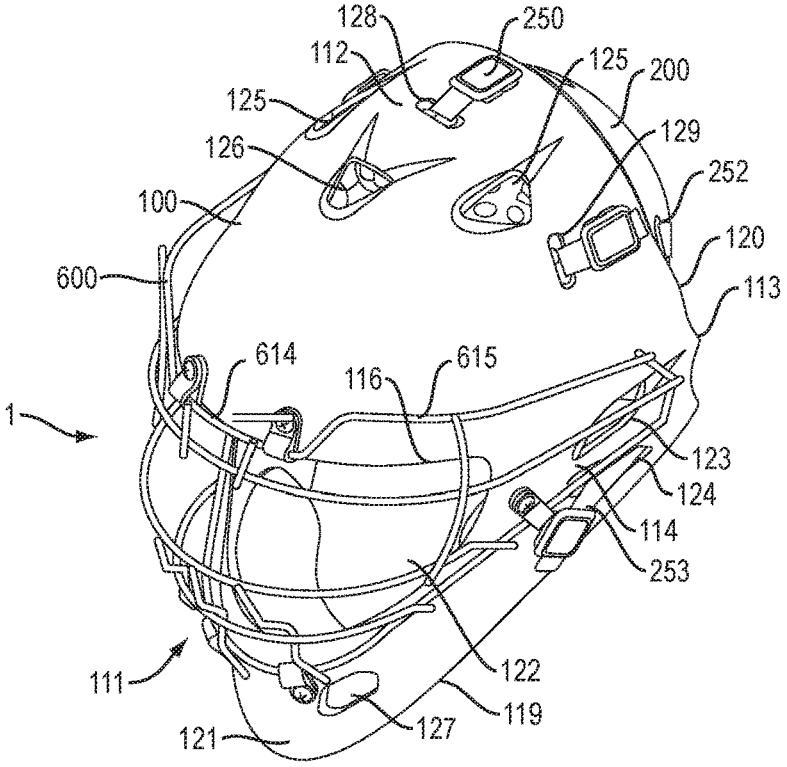
FIG. 2 is a left perspective view of a catcher's mask according to the subject technology.
Figure 3:
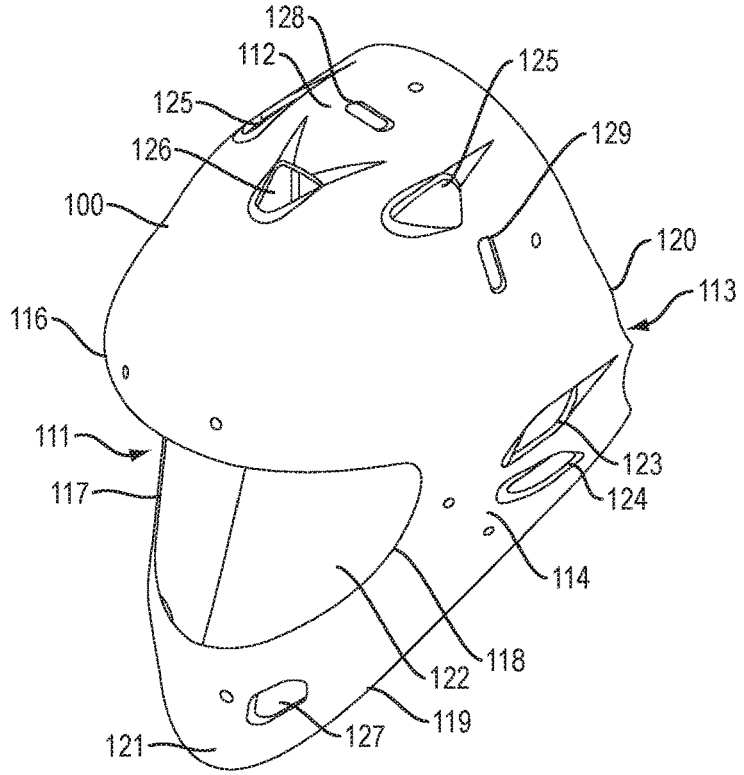
FIG. 3 is a left perspective view of a front shell of a catcher's mask according to the subject technology.
Figure 4:
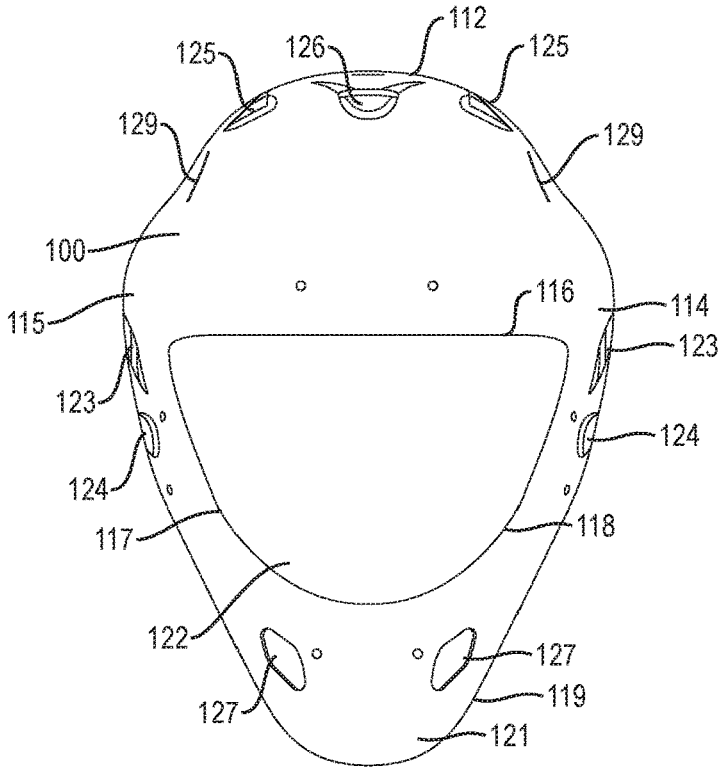
FIG. 4 is a front view of a front shell of a catcher's mask according to the subject technology.
Figure 5:
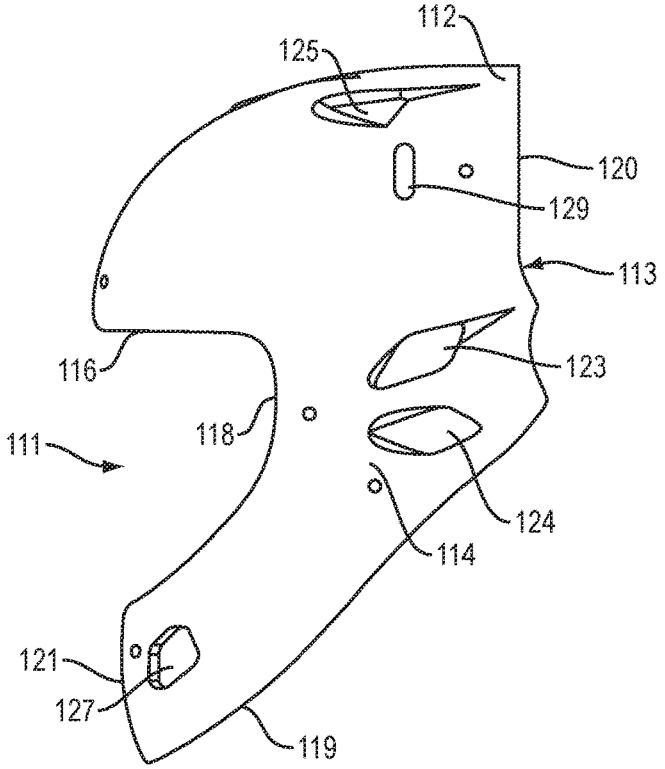
FIG. 5 is a right side view of a front shell of a catcher's mask according to the subject technology.
Figure 6:
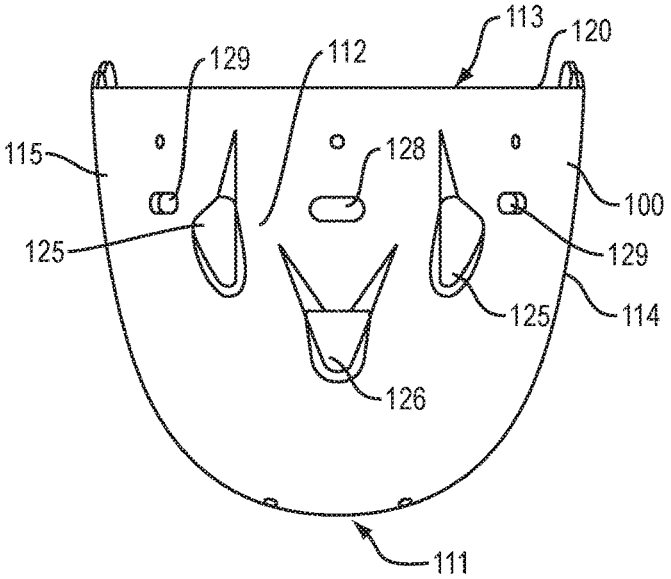
FIG. 6 is a top view of a front shell of a catcher's mask according to the subject technology.

Referring now to the drawings, in which like reference numerals are used to refer to the same or similar elements, FIGS. 1-8 show an embodiment of the shell, jaw protector, and face guard of the subject technology. Catcher's mask 1 comprises a rigid single-piece front shell 100 and a rigid single-piece rear shell 200 is adapted to receive and protect the head of a wearer. Each of front shell 100 and rear shell 200 is formed of a suitable material such as polycarbonate or acrylonitrile butadiene styrene plastic. Front shell 100 and rear shell 200 may be fabricated by methods known to those of skill in the art such as injection molding or thermoforming. Front shell 100 may have a thickness in the range of 0.11 inches to 0.14 inches, or 0.11 inches to 0.135 inches, or 0.11 inches to 0.13 inches. Rear shell 200 may have a thickness in the range of 0.11 inches to 0.14 inches, or 0.11 inches to 0.135 inches, or 0.11 inches to 0.13 inches. This is in contrast to a shell for use in football, which may have a thickness in the range of 0.14 inches and up.

In general configuration, front shell 100 has an inner surface and an outer surface. Front shell 100 has a front region 111, a crown region 112, a rear region 113, a left side region 114, and a right side region 115. Front shell 100 is bordered by an edge comprising top front edge 116, right front edge 117, left front edge 118, bottom edge 119, and rear edge 120.

Front shell 100 includes an integral full jaw protector 121. A face opening 122 in the front region 111 is defined by top front edge 116, right front edge 117 and left front edge 118. A rear opening is partially defined by rear edge 120.

Front shell 100 may have through-going ventilation holes. Ventilation holes in front shell 100 may include hole 126 centrally located in the crown region 112 and holes 125 located on the left side and right side of crown region 112. Front shell 100 may have one or more ear holes 123, 124 on each of the left side region 114 and right region 115. Slots 128, 129 are formed in front shell 100 for passage of the straps of strap harness 250 to connect rear shell 200 with front shell 100 in use. Jaw protector 121 may have ventilation holes 127, positioned on a left side and a right side of jaw protector 121.

A faceguard 600 for protecting the face of the wearer and comprised of wire members arranged as a grid may be removably attached to the shell 100 with straps and/or nuts, as shown. For example, faceguard 600 may be removably attached to shell 100 by loop straps connected by screws, nuts, and/or bolts to shell 100 through holes formed therein.

Faceguard 600 is a grid of wire members including horizontal wire members and vertical wire members connected together by, for example, welding. The wire members may be composed of steel or titanium. Faceguard 600 may be coated in a plastic or elastomer layer by, for example, dipping. Horizontal wire members may extend from a point rearward of ear holes 123, 124, in the left side region 114, across the face opening, to a point rearward of the ear holes 123, 124, in the left side region 115. In this manner, faceguard 600 may provide coverage over the area of the ear holes and thereby protect that area from blows sustained during sports play.

Figure 33:
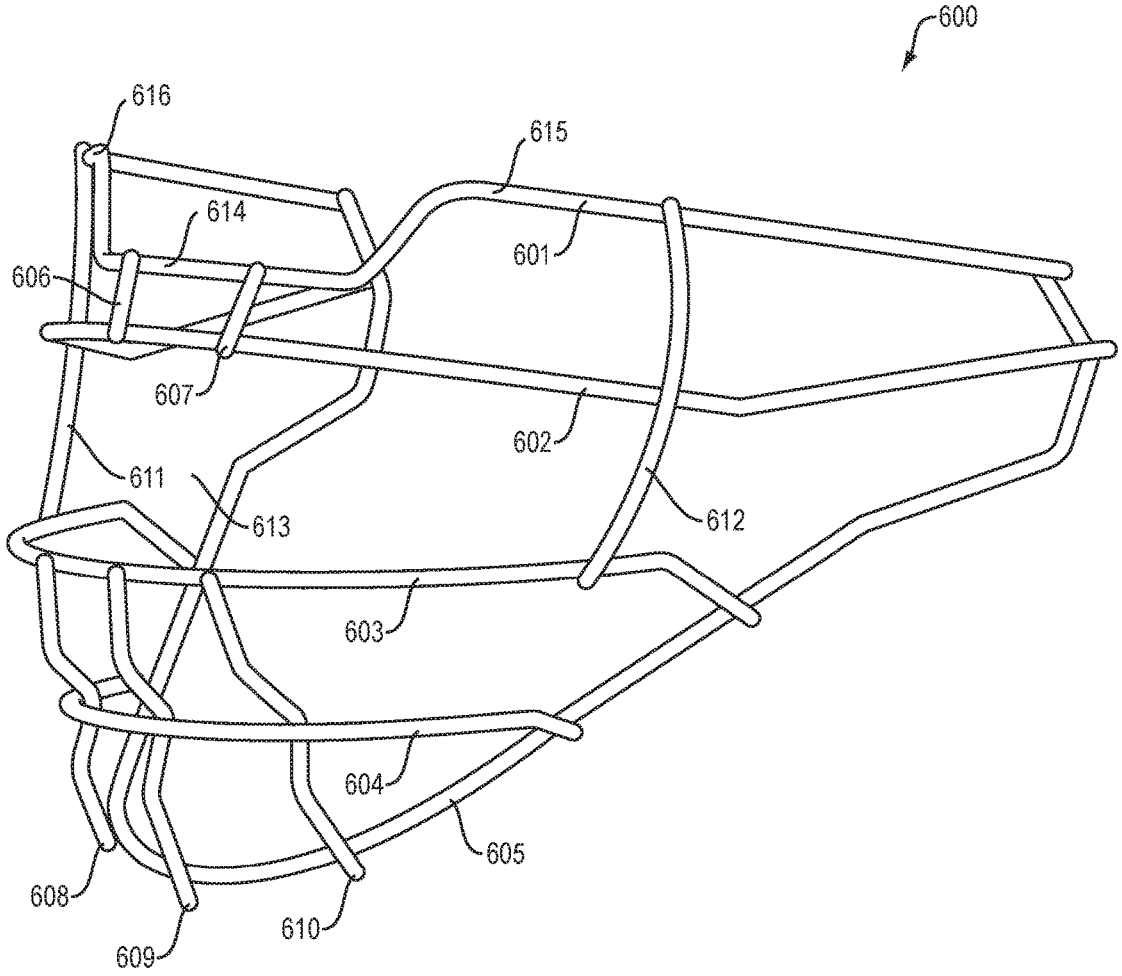
FIG. 33 is a left perspective view of a face guard for a catcher's mask according to the subject technology.
Figure 34:
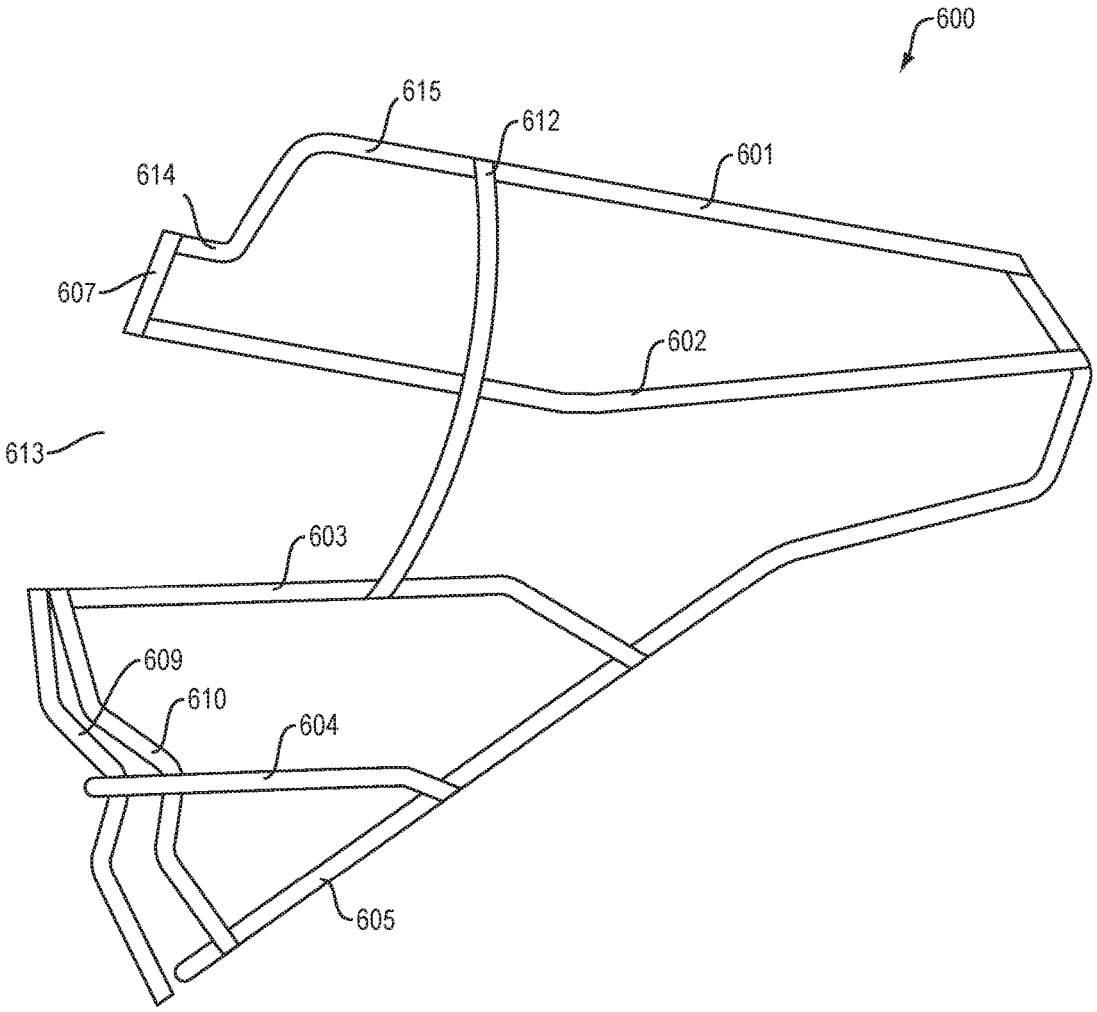
FIG. 34 is a side view of a face guard for a catcher's mask according to the subject technology.

Faceguard 600, best seen in FIGS. 33-34, comprises an upper pair of horizontal members, particularly, top upper member 601 and bottom upper member 602. Top upper member 601 is removably connected to front shell 100 by a pair of loop straps positioned in the front region 111 of front shell 100 above top front edge 116. When guard 601 is thus installed, bottom upper member 602 is positioned at, or slightly below, or slightly above top front edge 116, while top upper member 601 is positioned above top front edge 116. Top upper member 601 and bottom upper member 602 are connected to each other by vertical wire members 606, 607.

Faceguard 600 comprises a further three horizontal members, specifically, top lower member 603, middle lower member 604, and bottom lower member 605. Members 603, 604, and 605 are connected to each other by vertical members 608, 609, 610. Bottom lower member 605 is removably connected to front shell 100 by a loop straps positioned in the front region 111 of front shell 100 below right front edge 117 and left front edge 118.

Top upper member 601, bottom upper member 602 and top lower member 603 are connected to each other by vertical members 611, 612. A gap 613 is defined between bottom upper member 602 and top lower member 603, registering approximately with the wearer's eyes, to permit the wearer to better see through the mask.

Top upper member 601, bottom upper member 602 and bottom lower member 605 extend substantially past right front edge 117 and left front edge 118 (i.e., substantially past the edges of face opening 122) and meet at or beyond ear hole 123 to cover ear hole 123 and protect that area. More specifically, bottom lower member 605 is bent upwards at that point and top upper member 601 and bottom upper member 602 are joined to it.

Top upper member 601 comprises a center bar part 614, a left side bar part 615 bent upwardly with respect to the center bar part 614 to form an integral left eyebrow area, and a right side bar part 616 bent upwardly with respect to the center bar part 614 to form an integral right eyebrow area. The left side bar part 615 and right side bar part 616 may be bent upwardly to such an extent that they are above the center bar part 614 by at least a multiple of a diameter of the center bar part 614. As seen in FIG. 1, when faceguard 600 is installed on front shell 100, the left eyebrow area and right eyebrow area may be positioned above a top edge of the face opening.

Figure 35:
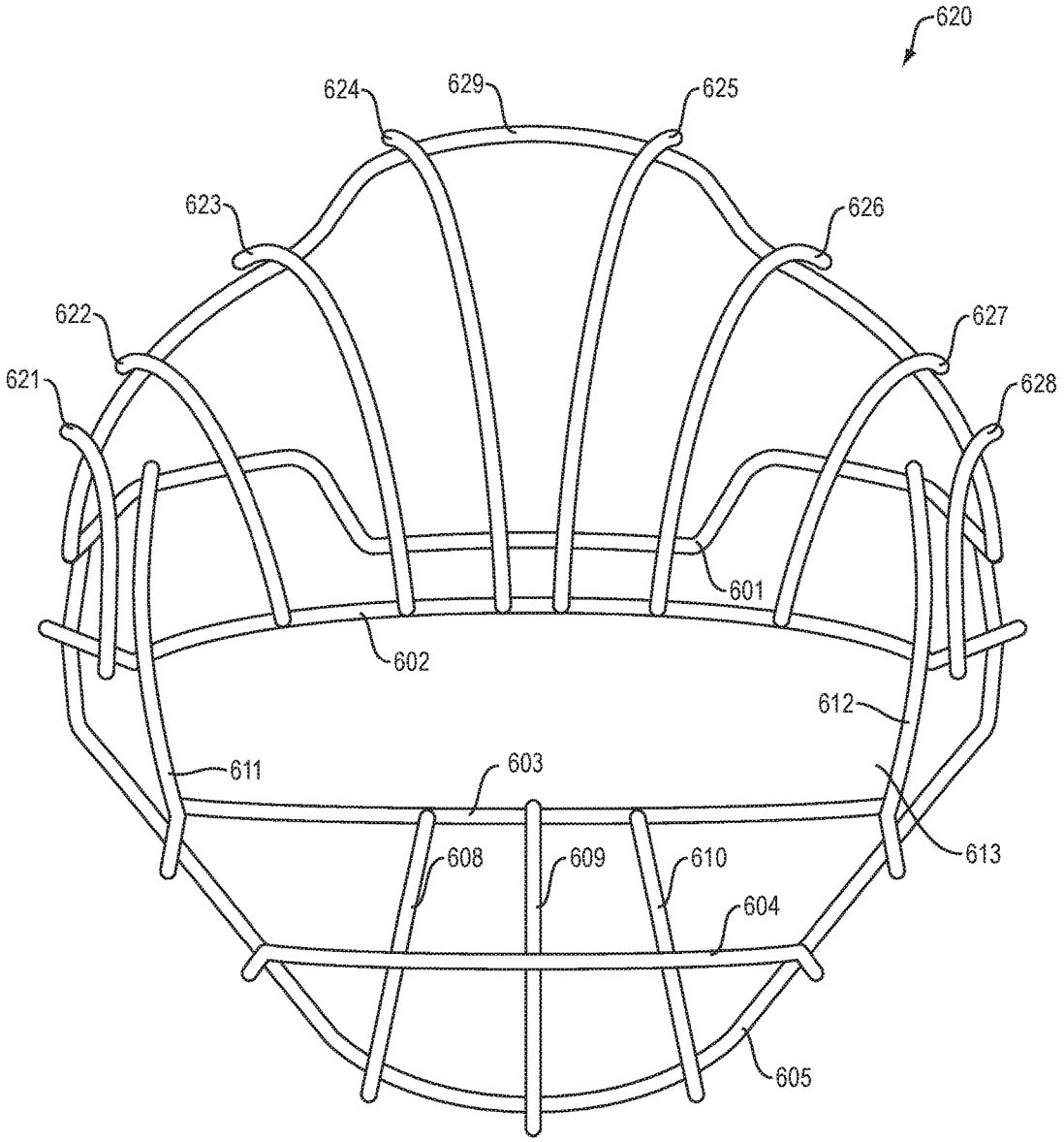
FIG. 35 is a front view of a face guard for a catcher's mask according to the subject technology.
Figure 36:
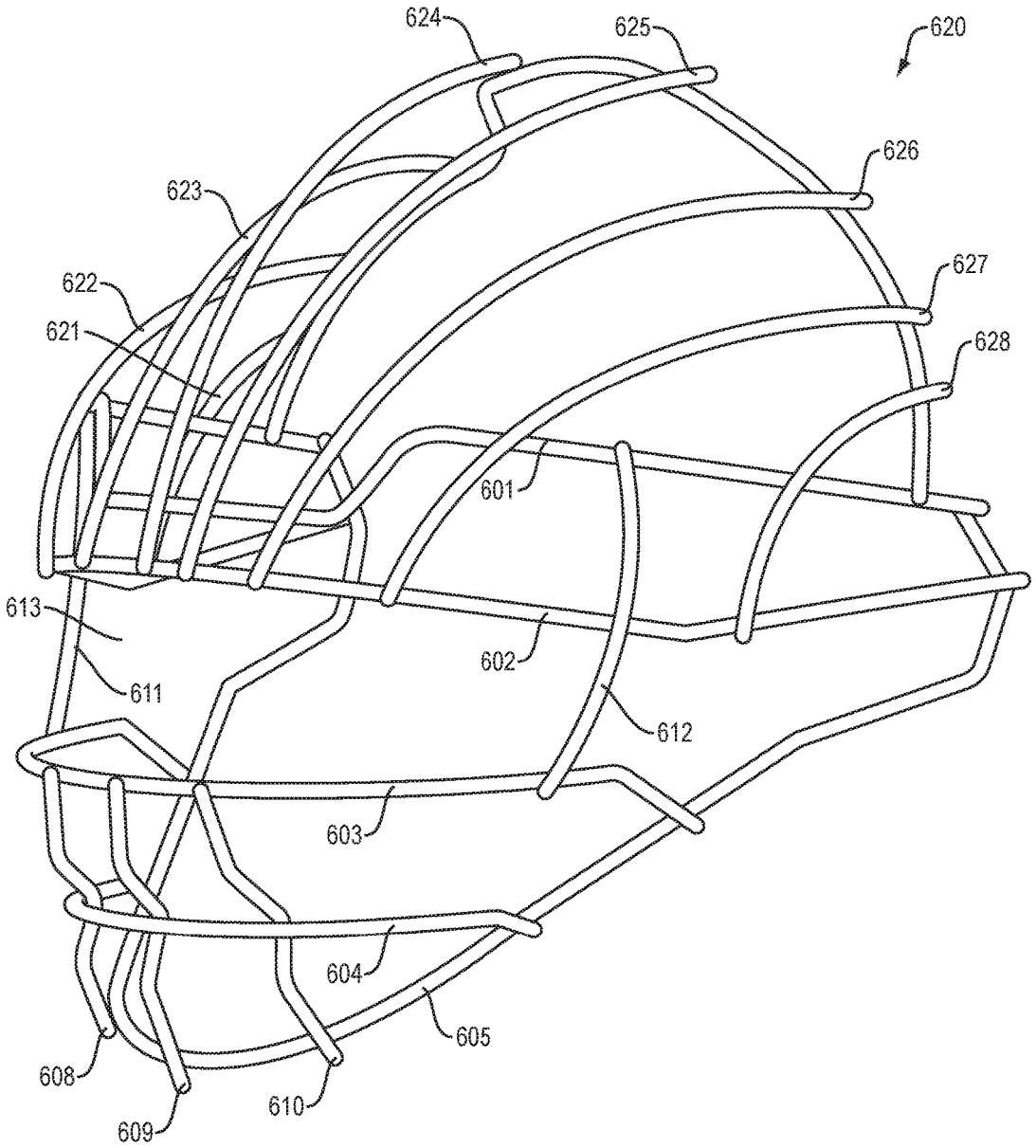
FIG. 36 is a left perspective view of a face guard for a catcher's mask according to the subject technology.
Figure 37:
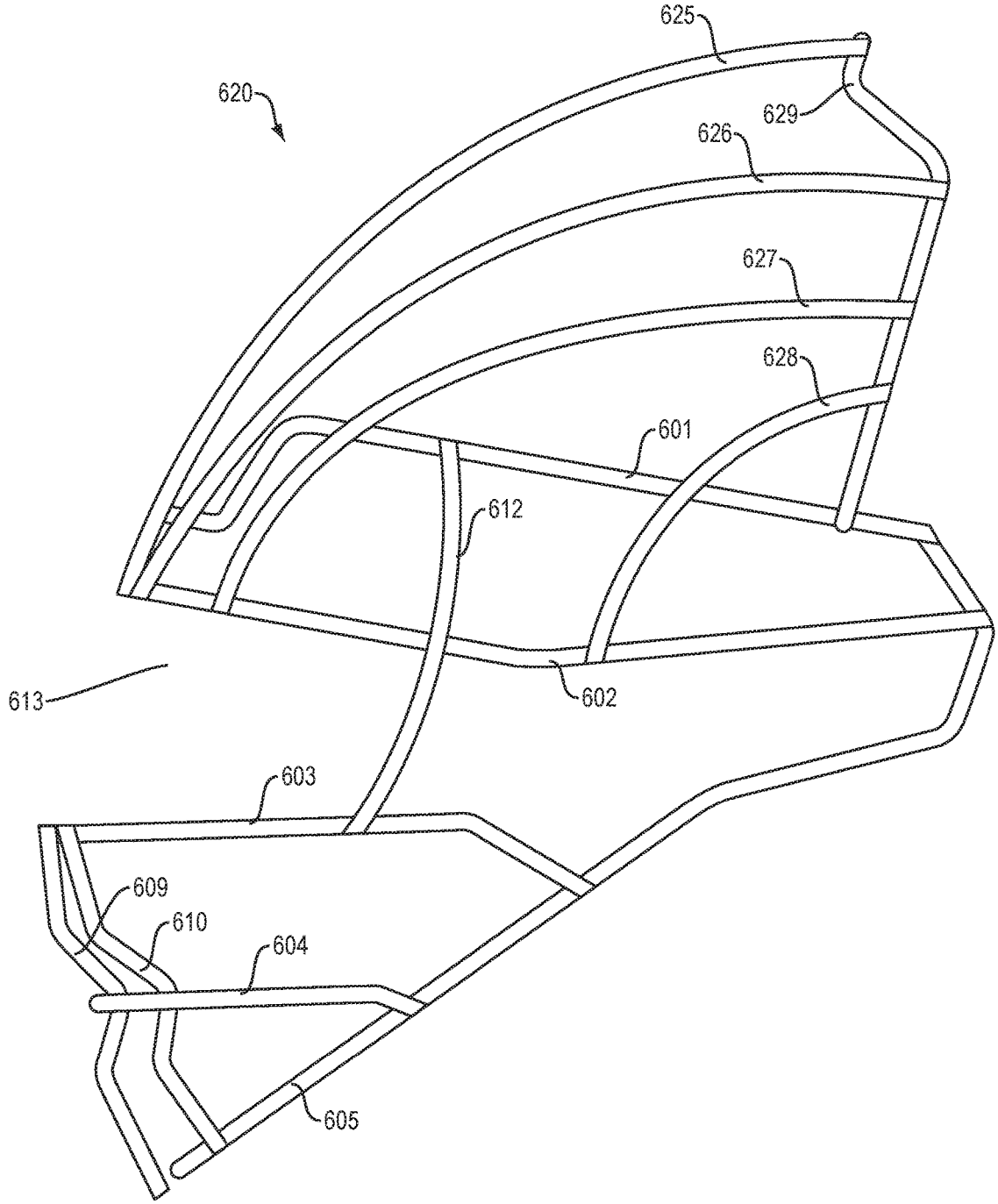
FIG. 37 is a side view of a face guard for a catcher's mask according to the subject technology.

An alternative face guard 620 for use in the catcher's mask 1 of the subject technology is shown in FIGS. 35-37. Face guard 620 is similar in structure and application to face guard 600, with the addition of right upward-sweeping members 621, 622, 623, 624 and left upward-sweeping members 625, 626, 627, 628. The provision of upward-sweeping members 621, 622, 623, 624, 625, 626, 627, 628 provides additional protection from frontal blows to the mask 1. Upward-sweeping members 621, 622, 623, 624, 625, 626, 627, 628 are joined together at their lower ends by bottom upper member 602, cross over and join with top upper member 601, and are joined together at their upper ends by crown arch member 629. Crown arch member 629 spans from the left side region, over the crown region, to the right side region, and joins top upper member 601 near its meeting points with bottom lower member 605.

In the embodiment of FIGS. 35-37, face guard 620 has eight upward-sweeping members, as shown. In alternative embodiments, face guard 620 may have two, four, six, or ten, or twelve upward sweeping members.

Catcher's mask 1 is provided with padding assemblies mounted to the inner surface of front shell 100 and rear shell 200 for shock absorption, to cushion blows sustained to mask 1 during sporting play, to size the mask to the wearer, and to provide comfort for the wearer. The padding assemblies are advantageously removably mounted to the inner surfaces of front shell 100 and rear shell 200 to enable replacement of worn padding, and to enable the use of padding of different sizes to custom-fit the mask to the wearer. The padding assemblies may be removably attached to the shell by hook-and-loop fasteners or by assemblies of screws and T-nuts passing through holes formed in the respective shells, as hereinafter described.

Figure 7:
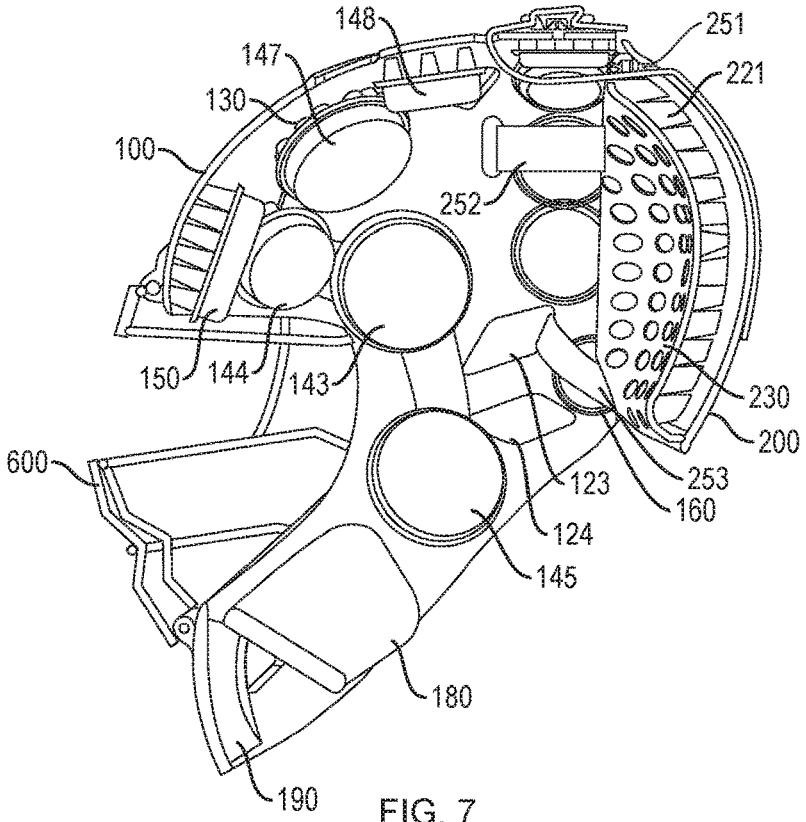
FIG. 7 is a right side cross-sectional view of a catcher's mask according to the subject technology.
Figure 8:
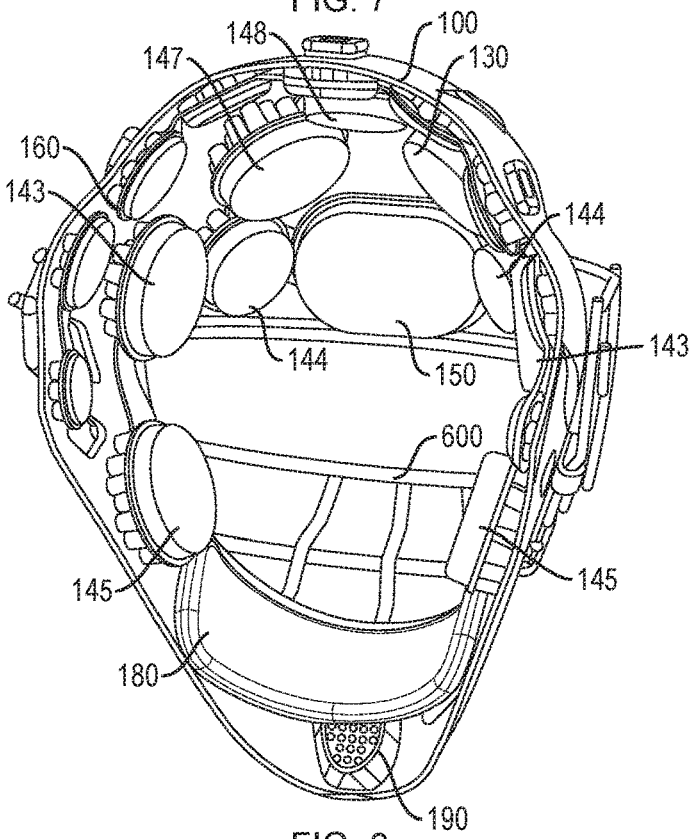
FIG. 8 is a rear view of a front shell with installed liners of a catcher's mask according to the subject technology.
Figure 9:
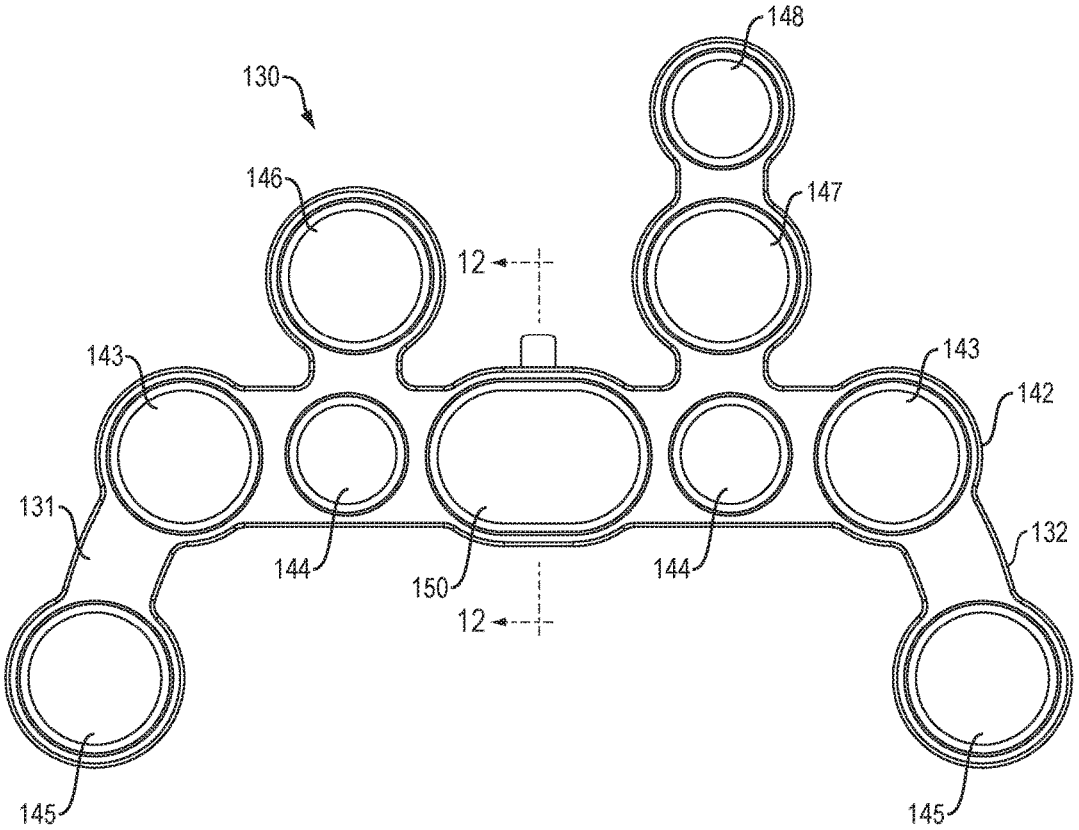
FIG. 9 is a top view of a front liner of a catcher's mask according to the subject technology.
Figure 10:
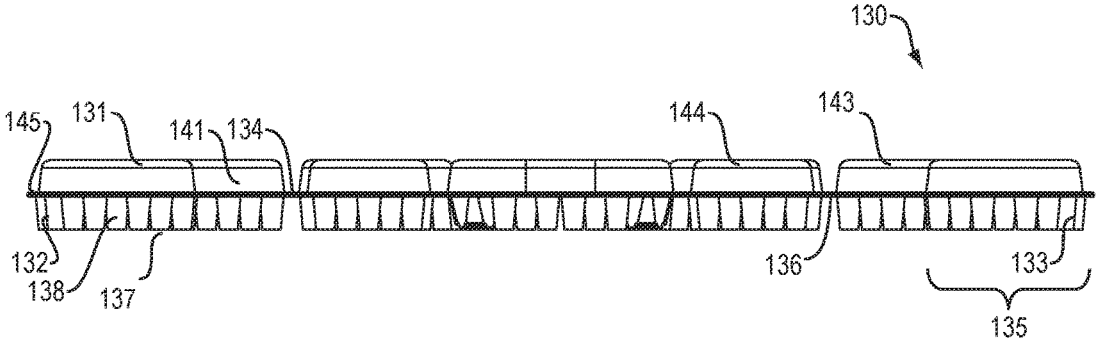
FIG. 10 is a side view of a front liner of a catcher's mask according to the subject technology.
Figure 11:
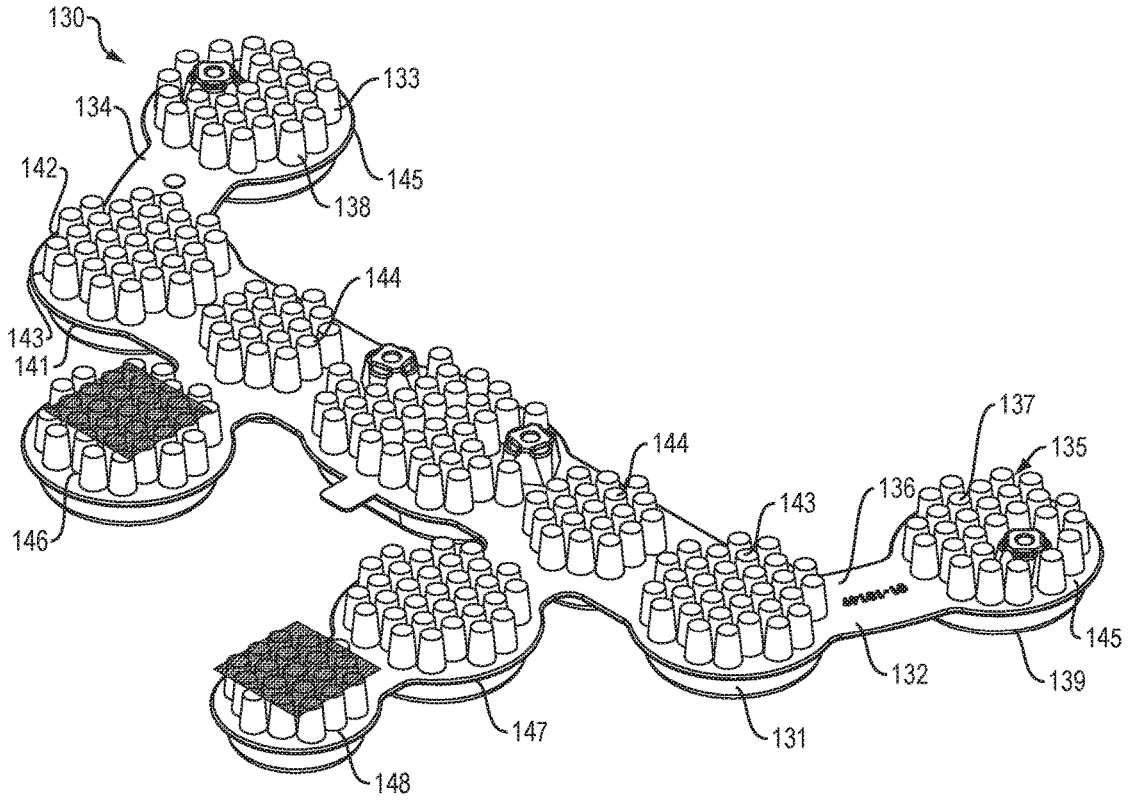
FIG. 11 is a rear perspective view of a front liner of a catcher's mask according to the subject technology.
Figure 12:
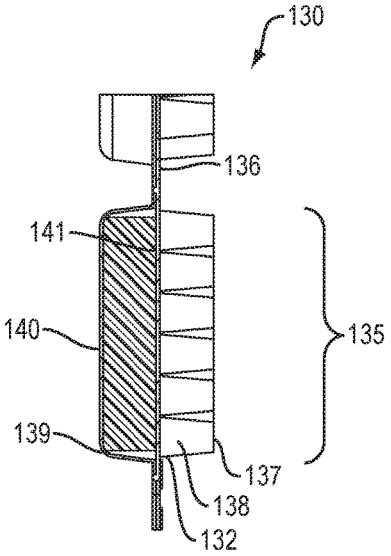
FIG. 12 a cross-sectional view of a front liner of a catcher's mask according to the subject technology.
Figure 13:
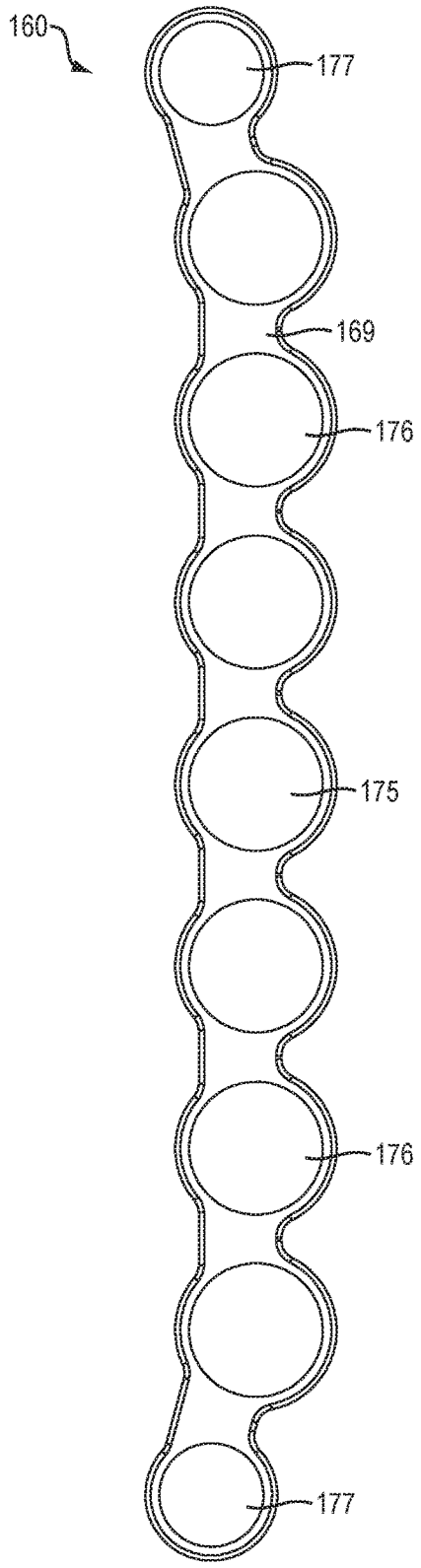
FIG. 13 is a top view of a middle liner of a catcher's mask according to the subject technology.
Figure 14:
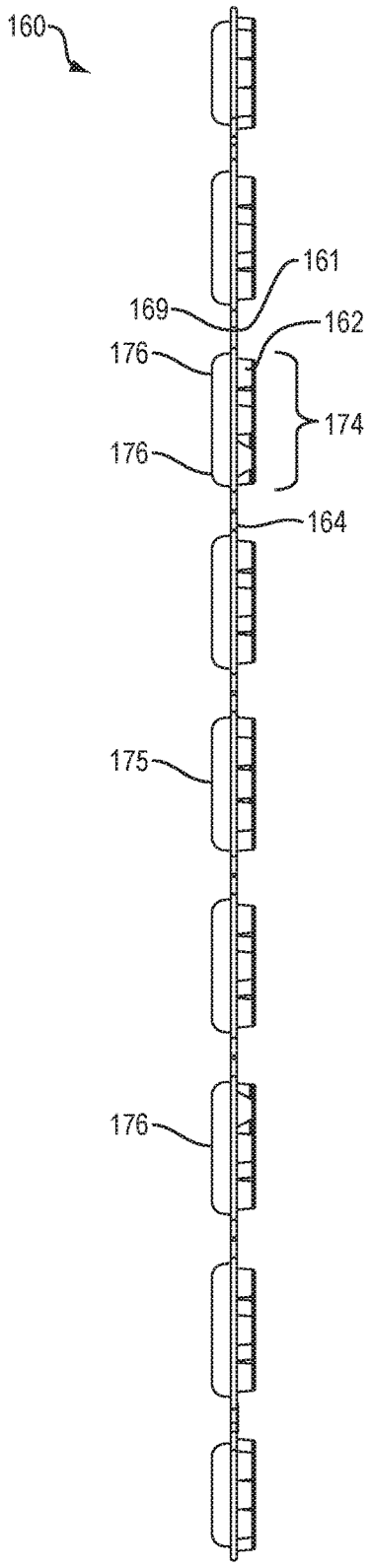
FIG. 14 is a side view of a middle liner of a catcher's mask according to the subject technology.
Figure 15:
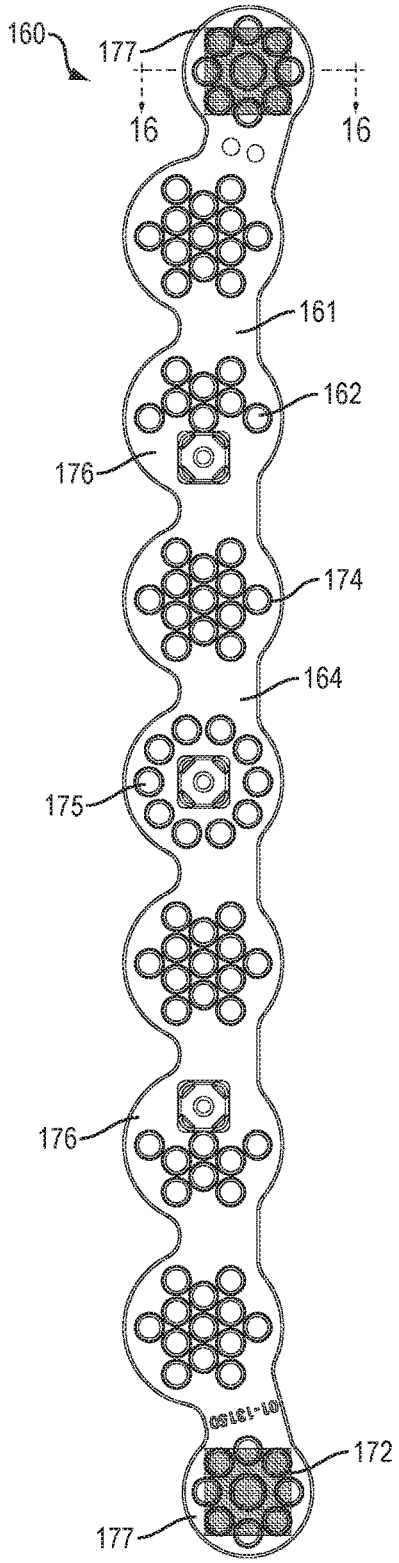
FIG. 15 is a rear view of a middle liner of a catcher's mask according to the subject technology.
Figure 16:
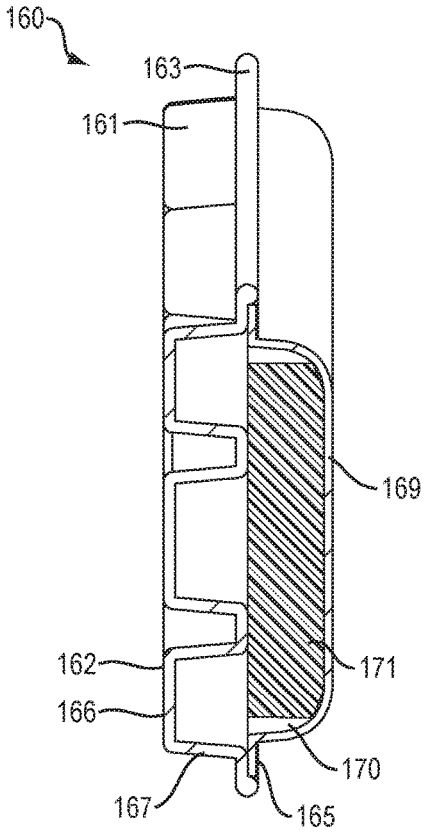
FIG. 16 is a cross-sectional view of a middle liner of a catcher's mask according to the subject technology.

As shown in FIGS. 7-8 and as hereinafter described, front shell 100 may be provided with padding comprising front liner 130, middle liner 160, jaw padding 180, and chin pad 190.

Turning to FIGS. 7-12, front liner 130 comprises inner layer 131 and shock absorbing layer 132, both layers consisting of a durable, smooth, substantially non-porous material such as thermoplastic polyurethane ("TPU").

Protective arrangements for helmets formed of injection molded TPU parts are disclosed in U.S. Pat. No. 8,069,498, and the shock absorbing layers 132, 161, and 221 of the front liner 130, middle liner 160, and rear liner 230 of the subject technology may be constructed as in that patent, the entirety of which is incorporated by reference. Suitable TPU material is available from Bayer. Layer 131 may be fabricated by thermoforming. Layer 131 has a plurality of spaced-apart, projecting, hollow, generally conical protrusions 133 protruding from a base sheet 134 and distributed over the coverage area. Protrusions 133 are grouped into a plurality of clusters 135 spaced apart by regions 136 of the base sheet having no protrusions. Each protrusion 133 has an open, preferably circular larger diameter base at the sheet 134 from which it extends, and a smaller diameter, preferably flat circular peak 137, and a preferably curved or straight frustoconical side wall 138 that tapers from the open base to the closed peak 137. Side wall 138 may define an angle of 10 degrees or approximately 10 degrees. A circular peak may be formed with a peak opening therein. Each side wall 138 is collapsible for absorbing shocks which may be transmitted to each protrusion 133. The protrusions 133 within each cluster 135 are spaced apart from each other for distributing the shock-absorbing effects of the protrusions 133 over the coverage area of each respective cluster 135. The height of the protrusions 133 may be 0.50 inches or approximately 0.50 inches. The inner diameter of the base of a protrusion 133 may be 0.34 inches or approximately 0.34 inches. The diameter of peak 137 may be 0.26 inches or approximately 0.26 inches. The thickness of base sheet 134, side walls 138, and peaks 137, may be 0.035 inches or approximately 0.035 inches.

Inner layer 131 may be composed of a thin sheet of TPU material. Inner layer 131 may be formed by thermoforming and has the same general shape as shock absorbing layer 132 such that layer 131 can overlay and register with layer 132. Pockets 139 are formed in inner layer 131, in such locations and with such shapes as to generally overlay and register with clusters 135 of protrusions 133. Pockets 139 may taper slightly from base to crown. Foam pads 140 may be provided in pockets 139. Foam pads 140 may be of any suitable material including foam rubber, shock foam, or memory foam. Suitable materials for foam pads 140 include Omalon® foam, available from Carpenter Co. of Richmond, Va. Foam pads 140 may have a thickness of 0.50 inches or approximately 0.50 inches. Preferably, inner layer 131 should be fully sealed to layer 132 except where pockets 139 are provided.

In general configuration, front liner 130 is comprised of cushions integrally formed in the liner, each cushion formed of a cluster 135 of protrusions 133 and its associated pocket 139 and pad 140. Cushions are connected by the interpositioned portions of layers 131 and 132 as shown. In the embodiment of the subject technology shown in FIGS. 7-12, front liner 130 comprises a central row 142 of cushions. Central row 142 comprises five cushions, including middle central cushion 150, side central cushions 143, and intermediate central cushions 144. Middle central cushion 150 may have an oval shape to cover a wider area in the center of central row 142. Side central cushions 143 and intermediate central cushions 144 may have round shapes. Intermediate central cushions 144 may have a smaller diameter than side central cushions 143. Intermediate central cushions 144 may have an inner diameter of 1.6 inches or approximately 1.6 inches. Side central cushions 143 may have an inner diameter of 2.0 inches or approximately 2.0 inches.

In the embodiment of the subject technology shown in FIGS. 7-12, front liner 130 further comprises jaw cushions 145 connected to side central cushions 143 of central row 142. Front liner 130 further comprises first crown cushion 146 connected at the location of an intermediate central cushion 144, and second crown cushion 147 and third crown cushion 148, attached in a row, at the location of the other intermediate central cushion 144. Jaw cushions 145 may have the same diameter or approximately the same diameter as side central cushions 143. Third crown cushion 148 may have the same diameter or approximately the same diameter as intermediate central cushions 144.

Front liner 130 is installed in front shell 100 by removable attachment to the inner surface of front shell 100, as follows. Front liner 130 is disposed on the inner surface of front shell 100 so that central row 142 is positioned above top front edge 116 to register approximately with the brow of the wearer. Middle central cushion 150 is positioned in the middle brow area to absorb impacts to that area. On either side of middle central cushion 150, central row 142 is curved inward somewhat to conform to the concave inner surface of front shell 100. Intermediate central cushions 144 are so spaced apart from middle central cushion 150, and so sized, so that when front liner 130 is installed in front shell 100, intermediate central cushions 144 are touching or are nearly touching middle central cushion 150 to provide continuous or nearly continuous protection for the middle brow area. Jaw cushions 145 are positioned over the upper jaw areas to absorb impacts to those areas. First crown cushion 146, second crown cushion 147 and third crown cushion 148 are positioned in the crown area to absorb impacts to that area. First crown cushion 146, second crown cushion 147, and third crown cushion 148 are curved inward somewhat to conform to the concave inner surface of front shell 100, with third crown cushion 148 positioned at the apex of the crown area.

Front liner 130 may be removably attached front shell 100 by hook-and-loop fasteners, screw-and-nut assemblies passing through holes formed in front shell 100 and layer 131, or both. In the embodiment of the subject technology shown in FIGS. 7-12, front liner 130 is removably attached by T-nuts and snap screws connected to the jaw cushions 145, the snap screws also serving as attachment points for strap 253 of strap harness 250; by a pair of T-nuts and screws connected to the middle central cushion 150, the screws also serving as attachments points for two loop straps connecting face guard 600 to shell 100; and by pads of hook-and-loop fastener material connected to first crown cushion 146 and third crown cushion 148.

Turning now to FIGS. 13-16, middle liner 160 comprises shock absorbing layer 161 and inner layer 169, both layers consisting of a durable, smooth, substantially non-porous material such as TPU. The construction of middle liner 160 is similar to front liner 130. Layer 161 has a plurality of spaced-apart, projecting, hollow, generally conical protrusions 162 protruding from a base sheet 163 and distributed over the coverage area. Protrusions 162 are grouped into a plurality of clusters 174 spaced apart by regions 164 of the base sheet having no protrusions. Each protrusion 162 has an open, preferably circular larger diameter base 165 at the sheet 163 from which it extends, and a smaller diameter, preferably flat circular peak 166, and a preferably curved or straight frustoconical side wall 167 that tapers from the open base 165 to the closed peak 166. Side wall 167 may define an angle of 10 degrees or approximately 10 degrees. Each side wall 167 is collapsible for absorbing shocks which may be transmitted to each protrusion 162. The protrusions 162 within each cluster 174 are spaced apart from each other for distributing the shock-absorbing effects of the protrusions 162 over the coverage area of each respective cluster 174. The height of the protrusions 162 may be 0.25 inches or approximately 0.25 inches. The inner diameter of base 165 may be 0.344 inches or approximately 0.344 inches. The diameter of peaks 166 may be 0.311 inches or approximately 0.311 inches. The thickness of base sheet 163, side walls 167, and peaks 168, may be 0.035 inches or approximately 0.035 inches.

Inner layer 169 of middle liner 160 may be composed of a thin sheet of TPU material. Inner layer 169 may be formed by thermoforming and has the same general shape as shock absorbing layer 161 such that layer 162 can overlay and register with layer 161. Pockets 170 are formed in inner layer 162, in such locations and with such shapes as to generally overlay and register with clusters 174 of protrusions 162. Pockets 170 may taper slightly from base to crown. Foam pads 171 may be provided in pockets 170. Foam pads 171 may be of any suitable material including foam rubber, shock foam, or memory foam. Suitable materials for form pads 171 include Omalon® foam. Foam pads 171 may have a thickness of 0.25 inches or approximately 0.25 inches. Preferably, inner layer 169 should be fully sealed to shock absorbing layer 161 except where pockets 170 are provided.

Middle liner 160 is installed in front shell 100 by removable attachment to the inner surface of front shell 100, as follows. Middle liner 160 is disposed on the inner surface of front shell 100 so that it is positioned along rear edge 120. In the embodiment of the subject technology shown in FIGS. 7,8, and 13-16, middle liner 160 is removably attached by T-nuts and snap screws connected to central cushions 175 and side cushions 176, the snap screws also serving as attachment points for strap 252 of strap harness 250; and by pads of hook-and-loop fastener material connected to end cushions 177.

Figure 17:
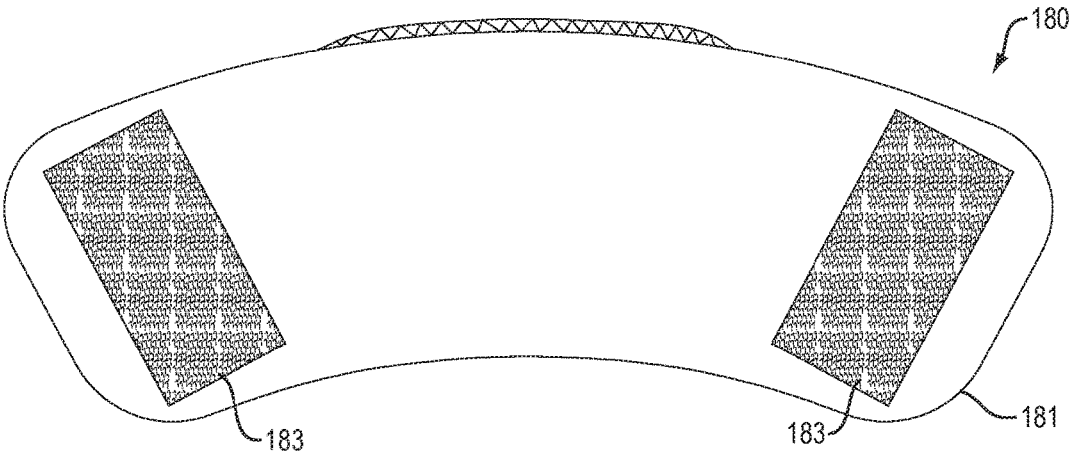
FIG. 17 is a rear view of jaw padding of a catcher's mask according to the subject technology.
Figure 18:
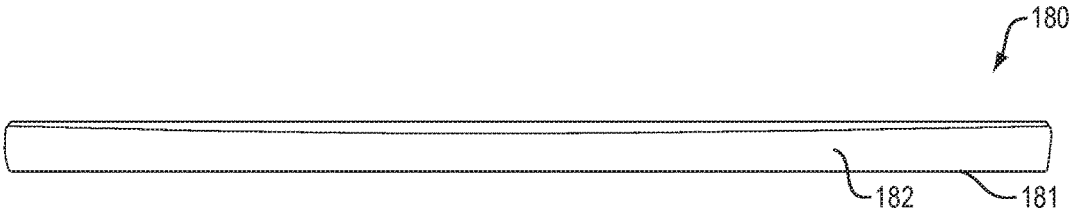
FIG. 18 is a side view of jaw padding of a catcher's mask according to the subject technology.
Figure 19:
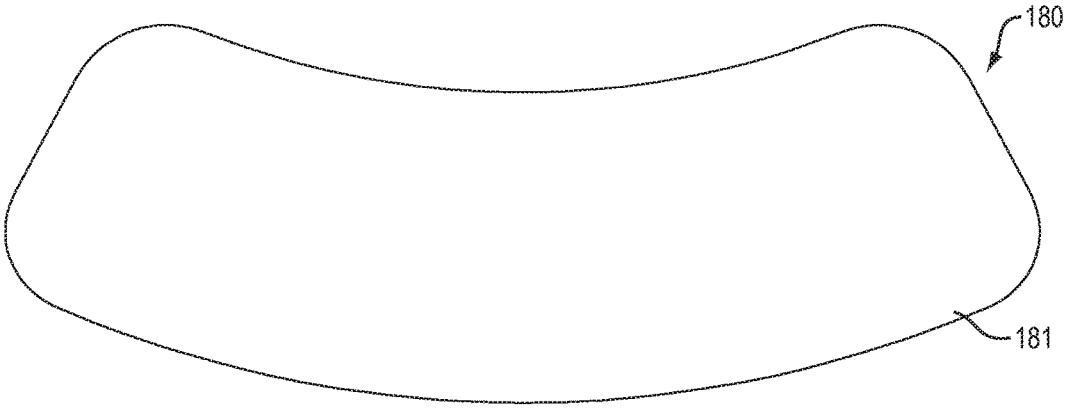
FIG. 19 is a front view of jaw padding of a catcher's mask according to the subject technology.

Turning now to FIGS. 17-19, jaw padding 180 comprises a thin, flexible, roughly kidney-shaped elongated foam member 182 enclosed in a comfort layer 181. Foam member 182 may be made of any suitable foam material such as polyurethane foam, memory form, or Omalon® foam. Comfort layer 181 may be made of any suitable, comfortable cloth material such as tricot or terrycloth. Jaw padding 180 may be removably attached to the inner surface of the full jaw protector by two pads 183 of hook-and-loop fastener material as shown in FIGS. 7, 8, suspended between the two attachment points such that comfort layer 181 is in contact with the chin of the wearer.

Figure 20:
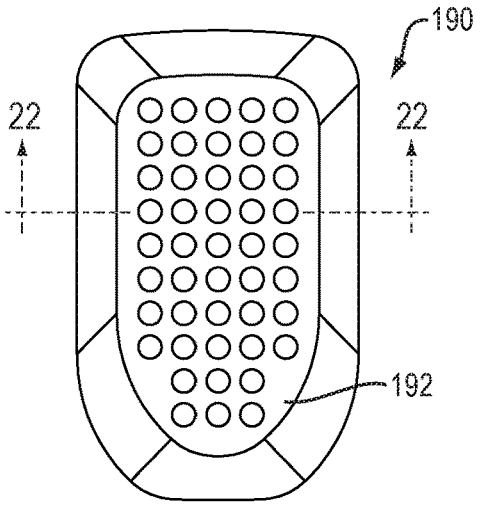
FIG. 20 is a front view of a chin pad of a catcher's mask according to the subject technology.
Figure 21:
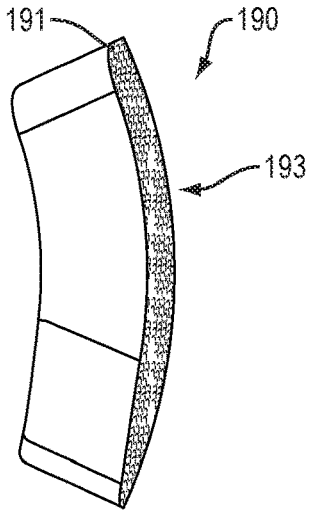
FIG. 21 is a side view of a chin pad of a catcher's mask according to the subject technology.
Figure 22:
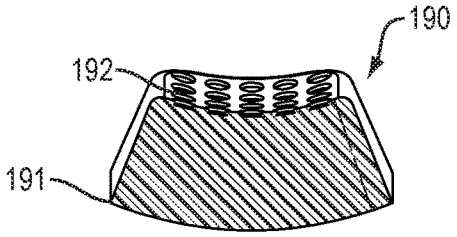
FIG. 22 is a cross-sectional view of a chin pad of a catcher's mask according to the subject technology.
Figure 23:
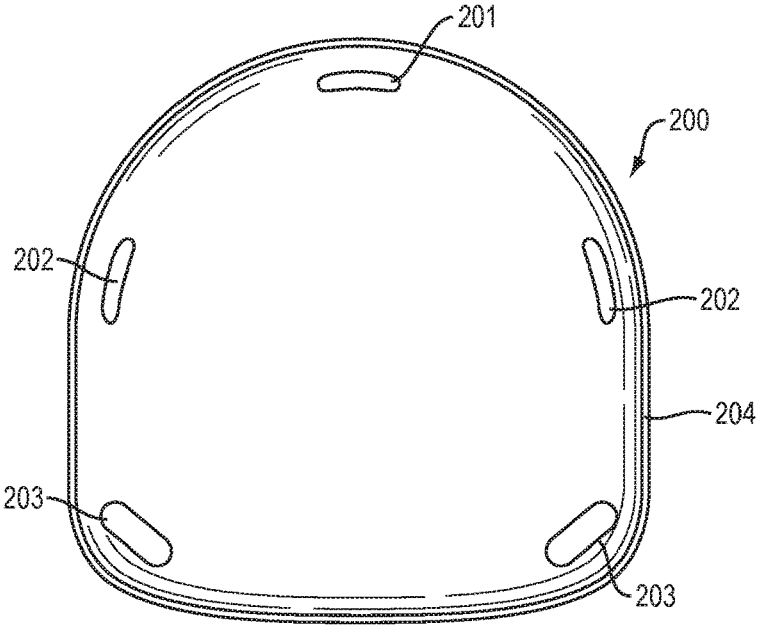
FIG. 23 is a rear view of a rear shell of a catcher's mask according to the subject technology.
Figure 24:
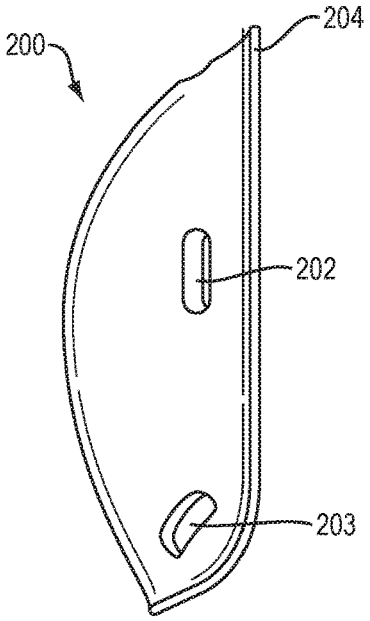
FIG. 24 is a rear view of a rear shell of a catcher's mask according to the subject technology.
Figure 25:
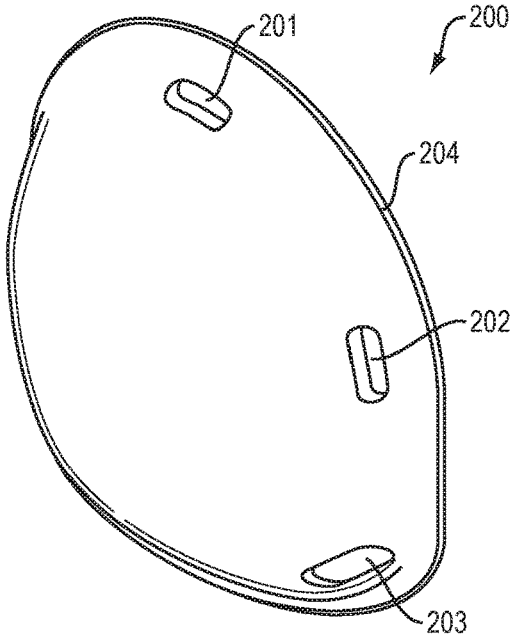
FIG. 25 is a right perspective view of a rear shell of a catcher's mask according to the subject technology.
Figure 26:
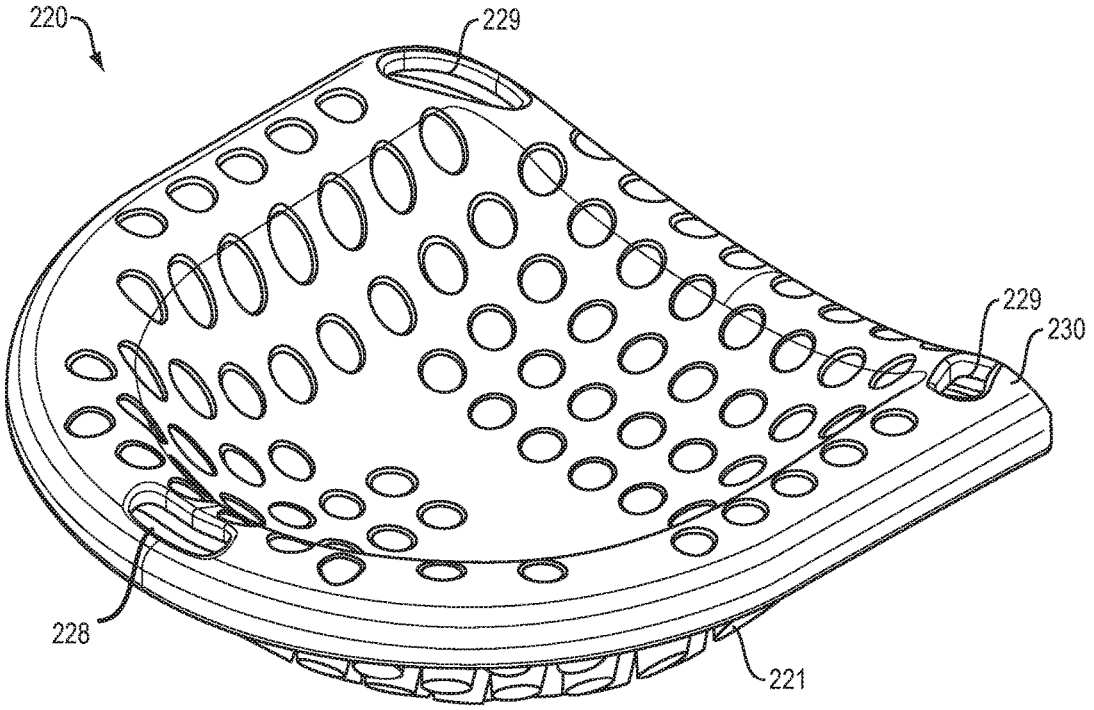
FIG. 26 is a right perspective view of a concave padding assembly for a rear shell of a catcher's mask according to the subject technology.
Figure 27:
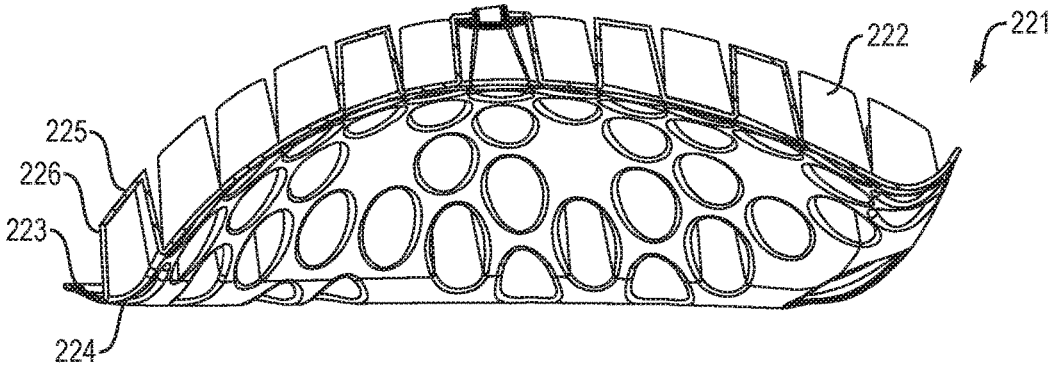
FIG. 27 is a cross-sectional view of a shock absorbing layer for a concave padding assembly for a rear shell of a catcher's mask according to the subject technology.
Figure 28:
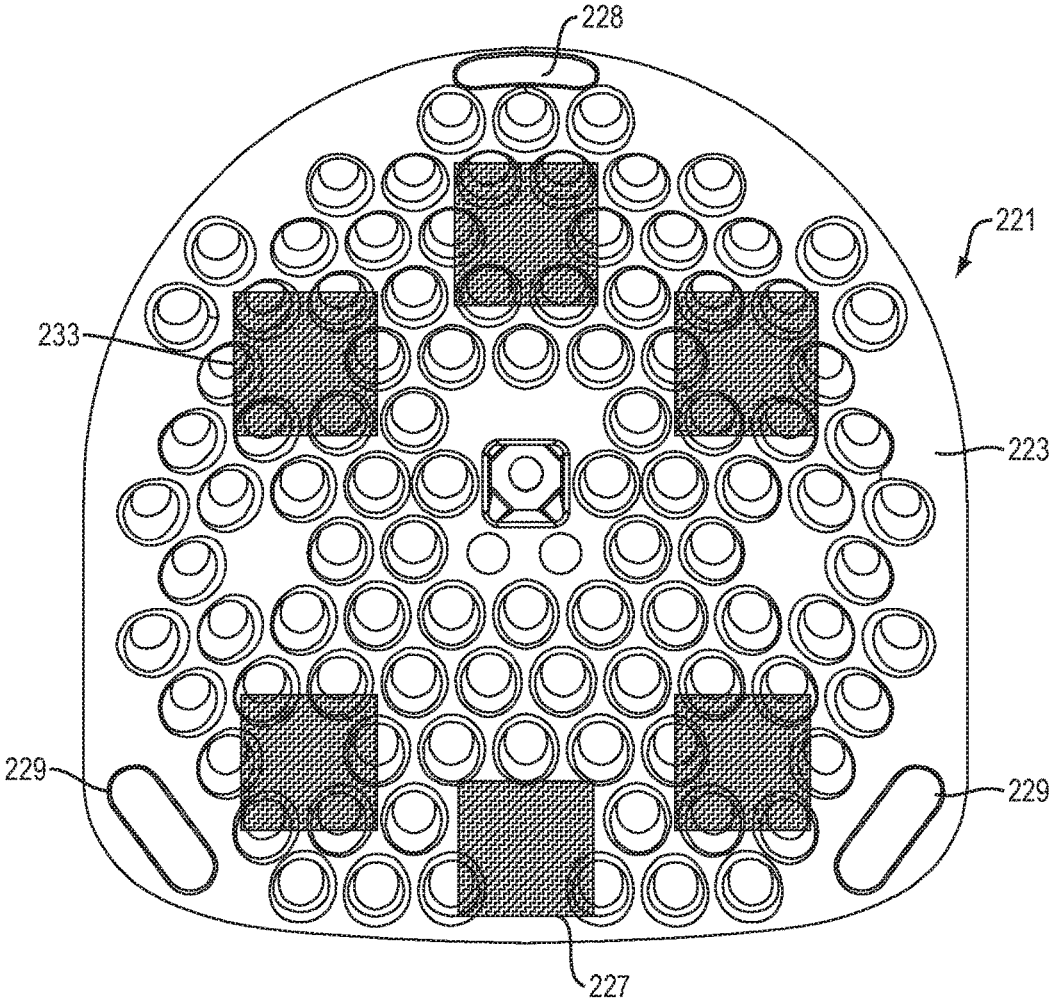
FIG. 28 is a front view of a shock absorbing layer for a concave padding assembly for a rear shell of a catcher's mask according to the subject technology.
Figure 29:
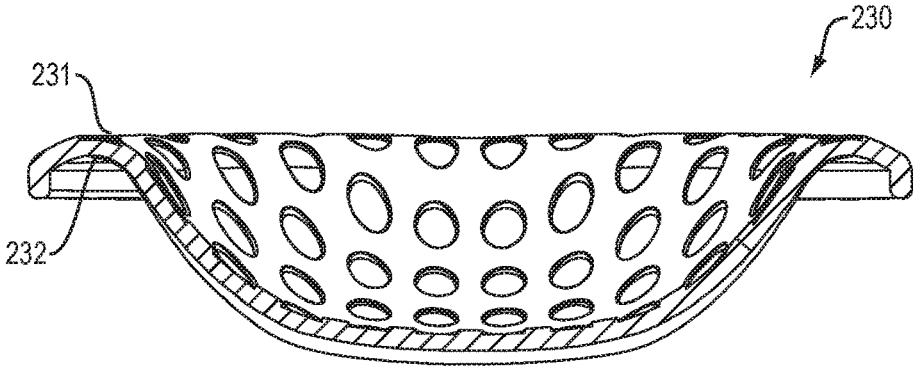
FIG. 29 is a cross-sectional view of a comfort layer for a concave padding assembly for a rear shell of a catcher's mask according to the subject technology.
Figure 30:
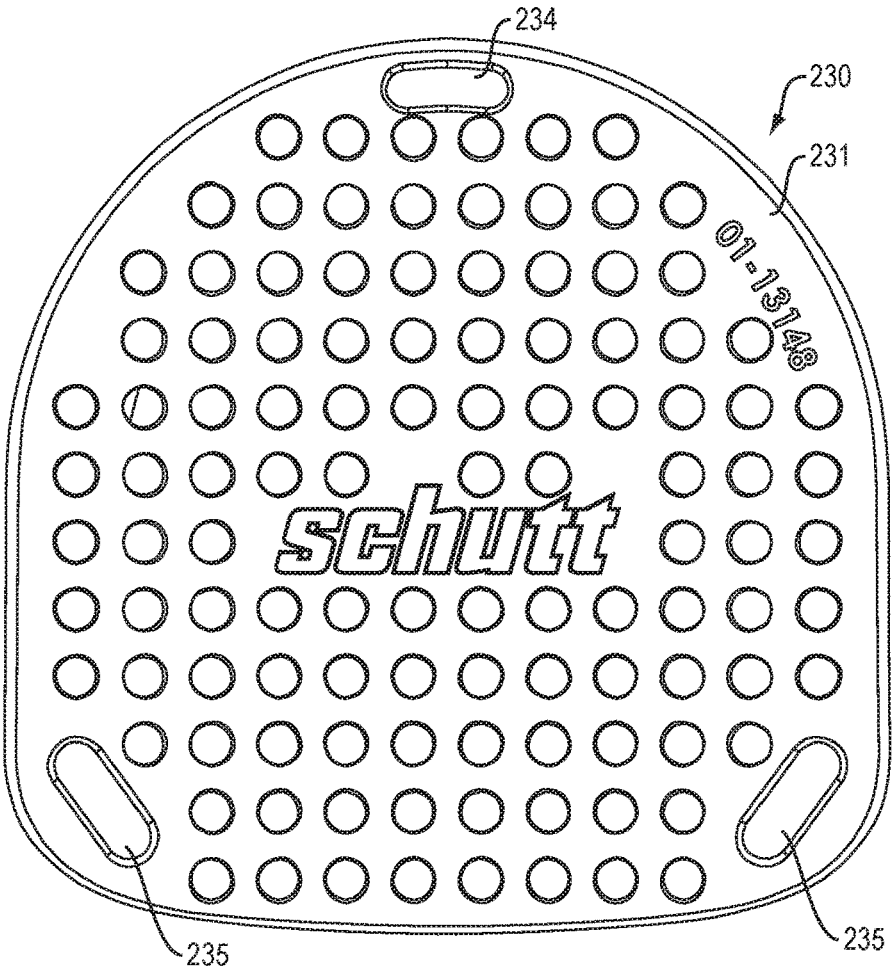
FIG. 30 is a front view of a comfort layer for a concave padding assembly for a rear shell of a catcher's mask according to the subject technology.

Turning now to FIGS. 20-22, chin pad 190 is removably attached to the inner surface of the full jaw protector, and is positioned to overlay the mental protuberance of the chin and absorb blows to the chin area. Chin pad 190 may comprise a single, roughly rectangular foam pad, tapering from base 191 to peak 192. The foam material of the chin pad may be ethylene-vinyl acetate (EVA) foam. Chin pad 190 may be removably attached to the inner surface of the full jaw protector by, for example, a pad of hook fastener material. Chin pad 190 may be backed with fabric material 183 such as tricot, and be removably attached thereby to a pad of hook material adhered to the inner surface of integral full jaw protector 121. Chin pad 190 is preferably curved so as to conform to the inner curvature of full jaw protector 121 where chin pad 190 is connected.

Turning now FIGS. 23-30, showing an embodiment of the rear shell and its associated padding assemblies, rear shell 200 is formed of a suitable material such as polycarbonate or acrylonitrile butadiene styrene plastic. Rear shell 200 has a concave configuration shaped to generally conform to the contour of the back of the wearer's head. Rear shell 200 has a plurality of through-going slots 201, 202, 203 formed therein for receiving straps of strap harness 250 to releasably attach rear shell 200 to front shell 100 as hereinafter described. A lip or flange 204 may be provided around the edge of rear shell 200.

A concave padding assembly 220 is provided on the inner surface of rear shell 200. Concave padding assembly 220 comprises a concave thermoformed TPU shock absorbing layer 221, shaped to nest within rear shell 200. Shock absorbing layer 221 has a plurality of spaced-apart, projecting, hollow, generally conical protrusions 222 protruding from a base sheet 223 and distributed over the coverage area. Each protrusion 222 has an open, preferably oval, larger-diameter base 224 at the sheet 223 from which it extends, a smaller-diameter peak 225, and a preferably curved or straight frustoconical side wall 226 that tapers from the open base 224 to the closed peak 225. Peaks 225 are oriented to form an angle with respect to their respective side walls 226, such that the peaks lie in a convex surface conforming to the concave inner surface of rear shell 200, so that when installed, the peaks 225 contact the inner surface of rear shell 200 without substantial deformation of the protrusions. Each side wall 226 is collapsible for absorbing shocks which may be transmitted to each protrusion 222. The protrusions 222 are spaced apart from each other for distributing the shock-absorbing effects of the protrusions 222 over the coverage area. The height of the protrusions 222 may be 0.50 inches or approximately 0.50 inches. The thickness of base sheet 133, side walls 137, and peaks 138, may be 0.035 inches or approximately 0.035 inches.

A concave comfort layer 230, which may be comprised of a molded pad 231 of foam material, for example, ethylene-vinyl acetate (EVA) foam material, with a backing 232 of tricot fabric is removably attached to the inner surface of the concave shock absorbing layer 221 and is shaped to nest within the concave shock absorbing layer 221. Molded pad 231 may have a thickness of 0.15 inches or approximately 0.15 inches. Hook pads may be adhered to the inner surface of shock absorbing layer 221 to removably connect with the tricot fabric backing 232 of concave comfort layer 230, for removable attachment. Slot 234 is formed in comfort layer 230 to register with slot 228 in concave padding assembly 220. Slots 235 are formed in comfort layer 230 to register with slots 229 in concave padding assembly 220.

Figure 31:
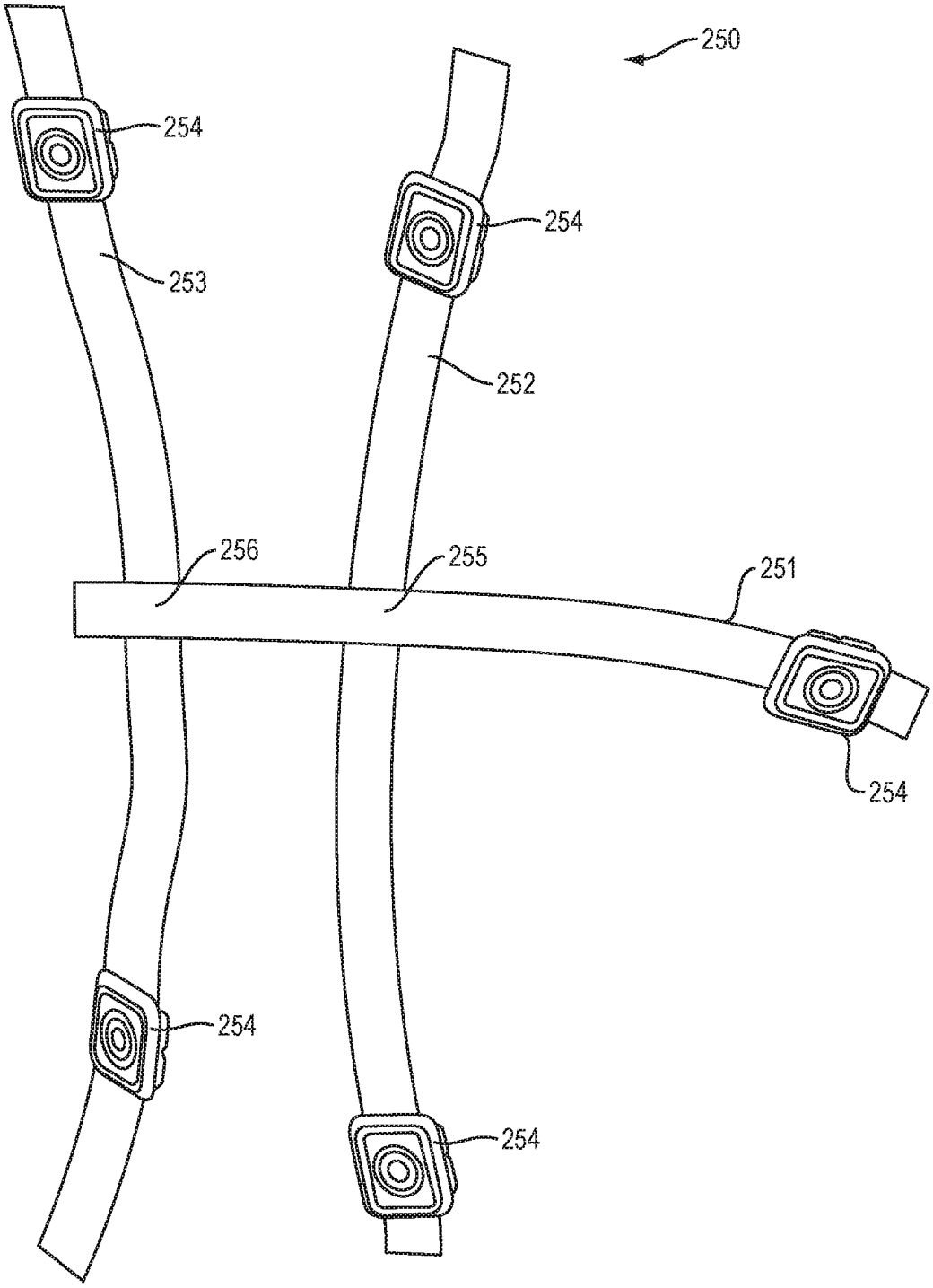
FIG. 31 is a front view of a strap harness for a catcher's mask according to the subject technology.
Figure 32:
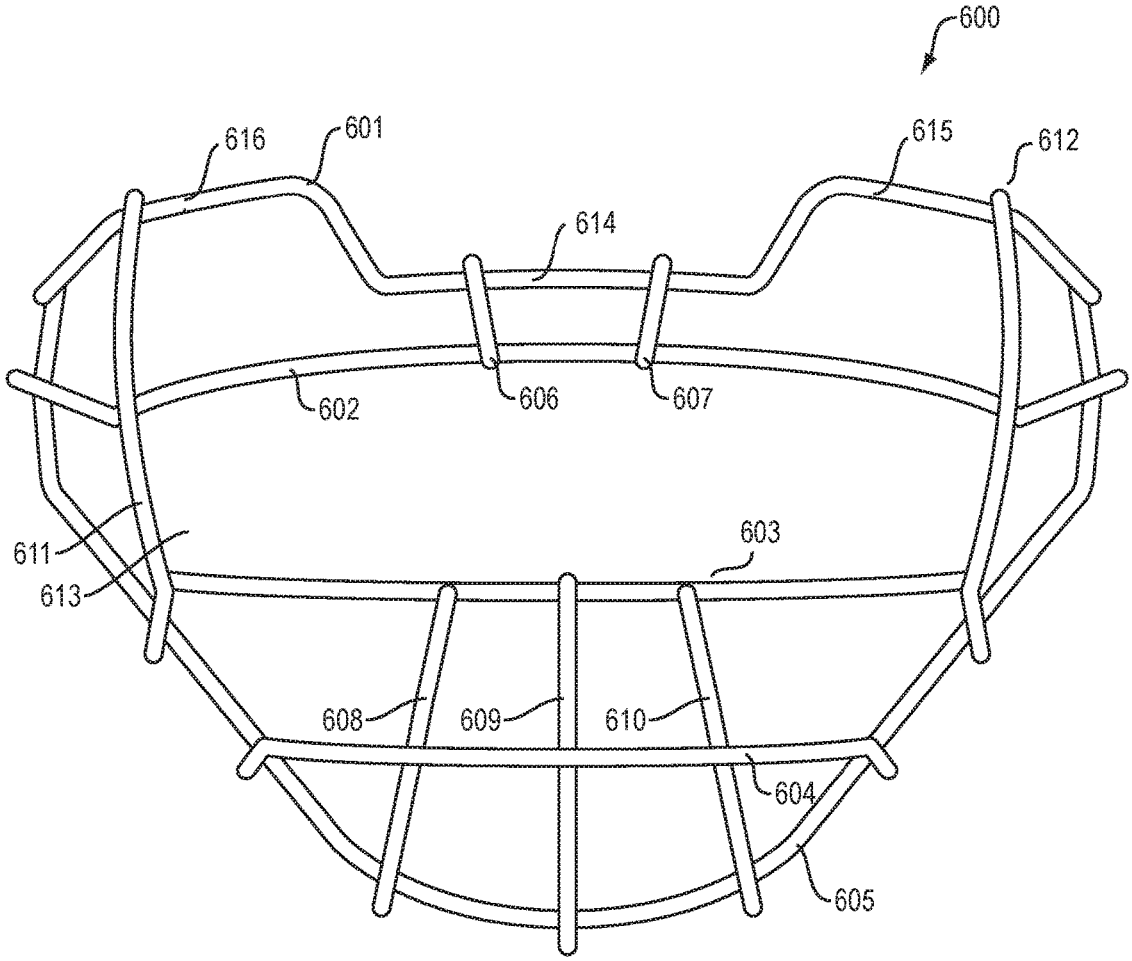
FIG. 32 is a front view of a face guard for a catcher's mask according to the subject technology.

Rear shell 200 is removably attached to front shell 100 by a strap harness 250. In the embodiment shown in FIG. 31, strap harness 250 is a generally H-shaped harness comprising central strap 251, top strap 252, and bottom strap 253. Central strap 251 may be doubled back and partially bonded to itself to form integral loops 255, 256 for slidable passage therethrough of top strap 252, and bottom strap 253 to form the general H-shaped configuration. The ends of central strap 251, top strap 252, and bottom strap 253 are provided with snap buckles 254 for removable attachment to snap screws provided on front shell 100. Central strap 251, top strap 252, and bottom strap 253 are preferably formed of elastic strapping material. Top strap 252 and bottom strap 253 may be comprised of two straps of elastic strapping material partially overlaid and stitched together to form a stronger strap.

In use, central strap 251, top strap 252, and bottom strap 253 pass through slots formed for that purpose in rear shell 200 and concave padding assembly 220, and front shell 100 as hereinafter described. Central strap 251 passes through slots 201, 228, 234 and 128, to emerge from front shell 100 and attach by its snap buckle 254 to the snap nut attached to cushion 175 of middle liner 160. Top strap 252 passes through slots 202, emerges through a gap between concave padding assembly 220 and rear shell 200, then passes through slots 129 to emerge from front shell 100 and attach by its snap buckles 254 to the snap nuts attached to cushions 176 of middle liner 160. Bottom strap 253 passes through slots 203, 229 and 235, then passes through lower ear holes 124 to emerge from front shell 100 and attach by its snap buckles 254 to the snap nuts attached to jaw cushions 145 of front liner 130.

While a specific embodiment of the invention has been shown and described in detail to illustrate the application of the principles of the invention, it will be understood that the invention may be embodied otherwise without departing from such principles. It will also be understood that the present invention includes any combination of the features and elements disclosed herein and any combination of equivalent features. The exemplary embodiments shown herein are presented for the purposes of illustration only and are not meant to limit the scope of the invention. Thus, all the features of all the embodiments disclosed herein are interchangeable so that any element of any embodiment may be applied to any of the embodiments taught herein.

What is claimed is:

1. A catcher's mask comprising:

a two-piece plastic shell composed of a front shell and a rear shell, the front shell being rigid and composed of plastic, the rear shell being rigid, concave, and composed of plastic, the front shell and a rear shell joined by an elastic strap harness, the two-piece plastic shell being adapted to receive and protect the head of a wearer;

the front shell having an inner surface, an outer surface, a front region, a crown region, a rear region, a left side region, and a right side region;

the front shell having two ear holes in the left region and two ear holes in the right region;

the front shell further having a face opening defined by a top front edge, a left front edge, and a right front edge;

the front shell further having a rear opening partially defined by a rear edge;

a full jaw protector integrally formed with the front shell and having an inner surface, a ventilation hole on the left side of the jaw protector, and a ventilation hole on the right side of the jaw protector;

a face guard removably attached to the front shell, the face guard comprising:

a plurality of wire members joined together to form a protective grid, adapted to cover at least the face opening;

the plurality of wire members comprising a top horizontal upper member and a bottom horizontal upper member;

the plurality of wire members further comprising a top horizontal lower member, a middle horizontal lower member, a bottom horizontal lower member, and a first vertical member connecting the top horizontal lower member, middle horizontal lower member, and bottom horizontal lower member;

the plurality of wire members further comprising a second vertical member and a third vertical member connecting the bottom horizontal upper member and top horizontal lower member;

wherein the bottom horizontal upper member and top horizontal lower member define a vision gap therebetween; and wherein the top upper member comprises a center bar part, a left side bar part bent upwardly with respect to the center bar part to form a left eyebrow area, and a right side bar part bent upwardly with respect to the center bar part to form a right eyebrow area.

2. The catcher's mask of claim 1 wherein the left eyebrow area and right eyebrow area are positioned above the top front edge of the face opening.

3. The catcher's mask of claim 1, wherein the left side bar part and right side bar part are bent upwardly to such an extent that they are above the center bar part by at least a multiple of a diameter of the center bar part.

4. The catcher's mask of claim 1 further comprising:

a chin pad removably attached to the inner surface of the full jaw protector to register approximately with the mental protuberance of the chin of the wearer;

the chin pad curved to conform to an inner curvature of the full jaw protector.

5. The catcher's mask of claim 4 wherein the chin pad comprises a roughly rectangular foam pad having sides tapering from a base to a peak.

6. The catcher's mask of claim 1 wherein the top upper member, bottom upper member and bottom lower member are adapted to extend substantially past the left edge and the right edge of the face opening to meet at or beyond the ear holes, thereby being adapted to extend the face guard over the ear holes and protect an area surrounding the ear holes.

7. A catcher's mask comprising a front shell and a rear shell attached to the front shell by an elastic strap harness, the front shell having an integral full jaw protector, and a face guard attached to the front shell, the face guard having a left side bar part and a right side bar part, said left side bar part and right side bar part being bent upward with respect to a center bar part to form left and right eyebrow protective areas that are substantially above a top edge of a face opening of the front shell.

8. The catcher's mask of claim 7 wherein the left side bar part and right side bar part are bent upwardly to such an extent that they are above the center bar part by at least a multiple of a diameter of the center bar part.

9. A catcher's mask comprising:

a front shell having a face opening and an integral full jaw protector;

a rear shell attached to the front shell by an elastic strap harness; and a face guard attached to the front shell;

wherein the face guard has left and right bar parts bent upward with respect to a center bar part to form left and right eyebrow protective areas that are substantially above a top edge of the face opening of the front shell.

10. The catcher's mask of claim 9 wherein the left and right bar parts are bent upwardly to such an extent that they are above the center bar part by at least a multiple of a diameter of the center bar part.

* * * * *